US010923304B1

(12) United States Patent
Juds et al.

(10) Patent No.: US 10,923,304 B1
(45) Date of Patent: Feb. 16, 2021

(54) VACUUM CIRCUIT BREAKER OPERATING MECHANISM

(71) Applicant: Eaton Intelligent Power Limited, Dublin (IE)

(72) Inventors: Mark A. Juds, New Berlin, WI (US); Paul R. Rakus, Coraopolis, PA (US); Michael Slepian, Murrysville, PA (US); Steven Chen, Moon Township, PA (US)

(73) Assignee: EATON INTELLIGENT POWER LIMITED, Dublin (IE)

( * ) Notice: Subject to any disclaimer, the term of this patent is extended or adjusted under 35 U.S.C. 154(b) by 0 days.

(21) Appl. No.: 16/569,711

(22) Filed: Sep. 13, 2019

(51) Int. Cl.

| | |
|---|---|
| ***H01H 33/666*** | (2006.01) |
| ***H01H 50/20*** | (2006.01) |
| ***H01H 50/44*** | (2006.01) |
| ***H01H 50/62*** | (2006.01) |
| ***H01H 50/64*** | (2006.01) |
| ***H01H 51/01*** | (2006.01) |

(52) U.S. Cl.
CPC ..... *H01H 33/6662* (2013.01); *H01H 50/20* (2013.01); *H01H 50/44* (2013.01); *H01H 50/62* (2013.01); *H01H 50/641* (2013.01); *H01H 51/01* (2013.01)

(58) Field of Classification Search
CPC ..... H01H 33/6662; H01H 33/6664; H01H 33/42; H01H 50/20; H01H 50/44; H01H 50/62; H01H 50/641; H01H 51/01; H01H 51/10; H01H 51/12; H01H 51/27; H01H 51/28; H01H 50/74; H01H 47/00; H01H 50/645; H01H 50/66
USPC ..... 218/140, 120, 154, 153, 118; 335/103, 335/161
See application file for complete search history.

(56) References Cited

U.S. PATENT DOCUMENTS 6,373,675 B1 4/2002 Yamazaki et al.
8,258,419 B2 * 9/2012 Jeong ..... H01H 79/00 218/68

(Continued)

FOREIGN PATENT DOCUMENTS

EP 0 867 903 A2 9/1998
JP 2003031087 * 1/2003 ..... H01H 33/6662

(Continued)

OTHER PUBLICATIONS

Translation of JP2003031087 (Original doc. published Jan. 31, 2003) (Year: 2003).*

(Continued)

*Primary Examiner* — William A Bolton
(74) *Attorney, Agent, or Firm* — Eckert Seamans Cherin & Mellott, LLC

(57) ABSTRACT

An operating mechanism for a circuit breaker including an opening, first actuator assembly and a closing, second actuator assembly. The first actuator assembly is structured to operatively engage at least one movable contact and is structured to move the at least one movable contact from a first configuration to a second configuration. The second actuator assembly is structured to operatively engage the at least one movable contact and is structured to move the at least one movable contact from the second configuration to the first configuration. The first actuator assembly and the second actuator assembly are split cooperative actuator assemblies.

18 Claims, 13 Drawing Sheets

(56) References Cited

U.S. PATENT DOCUMENTS

| | | | | |
|---|---|---|---|---|
| 9,508,514 | B2 * | 11/2016 | Ohda | H01H 33/38 |
| 2015/0235784 | A1 * | 8/2015 | Karlstrom | H01H 3/60<br>200/48 R |
| 2018/0218861 | A1 * | 8/2018 | Bindrich | H01H 33/666 |

FOREIGN PATENT DOCUMENTS

| | | | |
|---|---|---|---|
| WO | 2014/000790 | A1 | 1/2014 |
| WO | 2020126083 | A1 | 6/2020 |

OTHER PUBLICATIONS

European Patent Office "International Search Report and Written Opinion", for corresponding International application No. PCT/EP2020/025400, dated Nov. 19, 2020, 12 pp.

* cited by examiner

VACUUM CIRCUIT BREAKER OPERATING MECHANISM

BACKGROUND OF THE INVENTION

Field of the Invention

The disclosed and claimed concept relates to vacuum circuit interrupters and, more specifically, to an operating mechanism for a vacuum circuit interrupter.

Background Information

Circuit breaker assemblies provide protection for electrical systems from electrical fault conditions such as current overloads, short circuits, and low level voltage conditions.

Typically, circuit breakers include a spring-powered operating mechanism which opens electrical contacts to interrupt the current through the conductors in an electrical system in response to abnormal conditions. In particular, vacuum circuit interrupters include separable main contacts disposed within an insulated and hermetically sealed vacuum housing. That is, the main contacts typically include a fixed/stationary contact and a movable contact. The movable contact moves between an open, first positon, wherein the movable contact is spaced from, and not in electrical communication with, the stationary contact, and, a closed, second position, wherein the movable contact is coupled/directly coupled to, and is in electrical communication with, the fixed contact. Both the stationary contact and the movable contact are further coupled to, and are in electrical communication with, line and load conductors disposed outside the vacuum housing.

The contacts are part of a conductor assembly that also includes an elongated stem coupled to each contact. Generally, the conductor assembly stem with the stationary contact is fixed to the vacuum housing. The other conductor assembly stem is movable. That is, both the stem and the movable contact are movably coupled to the vacuum housing. The movable conductor assembly stem extends through the vacuum housing and an operating mechanism is operatively coupled to the exposed portion of the stem. To accommodate the moving stem and to maintain the vacuum in the vacuum chamber, the stem is sealingly coupled to a bellows.

The operating mechanism is structured to move the movable contact between the first and second positions. That is, within the operating mechanism there is a set of elements that open the contacts, i.e., move the movable contact from the second position to the first position, and, a set of elements that close the contacts, i.e., move the movable contact from the first position to the second position. Some of the operating mechanism elements are used for both motions. As used herein, the elements of the operating mechanism that move the movable contact from the second position to the first position are collectively identified as the "opening actuator." Conversely, and as used herein, the elements of the operating mechanism that move the movable contact from the first position to the second position are collectively identified as the "closing actuator." Certain elements of the operating mechanism are part of both the opening actuator and the closing actuator.

Generally, it is desirable to move the movable contact from the second position to the first position as quickly as possible. Various characteristics of the operating mechanism limit the speed at which the movable contact moves including the nature of how energy is provided to the operating mechanism and the weight/mass of the operating mechanism elements. That is, one type of operating mechanism utilizes springs and a linkage as the opening/closing actuators. That is, for example, there is an opening spring and a closing spring operatively coupled, via the linkage, to the movable contact. A trip device and/or manual opening device is operatively coupled to the operating mechanism. Assuming the contacts are in the second position, the trip/manual opening device is actuated which, in turn, actuates the operating mechanism. When this occurs, the energy in the opening spring is released and causes the movable contact to move from the second position to the first position. Further, in some operating mechanisms, the energy from the closing spring charges the opening spring. To move the movable contact from the second position to the first position, the operating mechanism is again actuated causing the energy of the closing spring to be released thereby moving the movable contact from the second position to the first position. When the movable contact is in the first or second position a motor or similar device charges the closing spring so that the operating mechanism is again ready to close the contacts. In other embodiments one, or both, spring(s) are charged at another time.

Other operating mechanisms use an electro-magnetic system to move the movable contact. For example, a Thomson coil, solenoid or similar construct, is coupled to the movable contact. When the Thomson coil is charged, the movable contact moves from the second position to the first position. In some of these embodiments, a spring/linkage assembly is used to move the movable contact from the first position to the second position. In other embodiments, a second Thomson coil is used to move the movable contact from the first position to the second position.

In all the systems described above, all the actuators that move the movable contact are coupled to the movable contact at all times. That is, for example, when the opening actuator is used to move the movable contact from the second position to the first position, i.e., when the contacts are opened, at least one of the elements of the closing actuator are coupled to the movable contact and must be moved along with the elements of the opening actuator. Thus, the opening actuator must be structured to, e.g., have the power to, move an element(s) of the closing actuator. Similarly, when the closing actuator is used to move the movable contact from the first position to the second position, i.e., when the contacts are closed, at least one of the elements of the opening actuator is coupled to the movable contact and must be moved along with the elements of the closing actuator. This is a problem. That is, the mass of the actuator elements that must be moved in addition to the mass of the movable contact requires more energy and a hardy actuator. As used herein, "hardy" means larger, and therefore structured to move, carry or support other components having a greater mass, than actuator elements of an operating mechanism including split cooperative actuators.

Moreover, these opening actuators allow an arc to form as the movable contact moves from the second position to the first position. That is, an arc forms between the fixed contact and the movable contact as the movable contact moves away from the fixed contact. The arc is extinguished when the movable contact moves a sufficient distance, i.e., a "minimum distance," away from the fixed contact. Generally, the greater the voltage associated with the current, a greater minimum separation is needed to extinguish the arc. So as to minimize the life of the arc, the movable contact must move the minimal distance quickly.

It is understood that circuit breakers, and the elements thereof, have different sizes. Generally, the larger the conductive elements, the greater the current and/or voltage rating of the circuit breaker. As the disclosed and claimed concept is not limited to a circuit breaker of a specific size, or rating, hereinafter, this specification will refer to a circuit breaker, or a contact, with "[X] characteristics." As used herein, a contact with "[X]characteristics" means a contact with a specific set of characteristics. As used herein, "characteristics" means, size, shape/configuration, mass, and material. It is understood that "[X]" is a variable associated with the power rating of the circuit breaker assembly. Generally, the greater the power rating of the circuit breaker assembly, the thicker/larger the "characteristics" of the contact. Further, a circuit breaker with "[X] characteristics" means a circuit breaker that includes a contact with "[X] characteristics." It is further understood that other aspects of a circuit breaker, or contact, identified with "[X]" means that aspect is associated with a contact having "[X] characteristics."

Further, it is known that the kinetic energy of each movable element is related to the square of the velocity of that element, and the potential energy is related to the square of the displacement of that element. That is, for a contact with [X] characteristics, it takes [X] amount of potential energy to move the movable contact (and associated moving elements) from the second position to the first position. Thus, operating mechanisms that use an electro-magnetic system include a coil structured to generate [X] amount of potential energy. Further, other elements of the operating mechanism must be sufficiently hardy (made from strong materials and have a sufficient cross-sectional shape or otherwise be sized) to handle [X] potential energy and [X] kinetic energy and stresses associated with the motion of the elements and the movable contact. This is a problem. It is understood that the equations used to determine [X] potential energy and [X] kinetic energy are well known to those of skill in the art. As such, the entirety of the equations are not set forth herein, but it is noted that the following equations are the basis for the performance calculations:

$V=I\ R+L\ dI/dt+IdL/dt$—Summation of Voltages $Q=I^2\ R$—Heat dissipation $L=N\ \phi/I$—Inductance $NI=\phi R$—Magnetic Flux $I_e=(N/R_e)d\phi/dt$—Eddy Current $F=I\ B\ l$—Lorentz Force $F=kx+m\ d^2x/dt^2$—Summation of Forces $KE=0.5\ m\ v^2$—Kinetic Energy $PE=0.5\ k\ x^2$—Potential Energy $\Delta T=Q/(h\ a)$—Temperature Rise Using these equations, and others, one of ordinary skill in the art can assemble and solve the complex system equations to determine the system performance. Further, as the contacts of a vacuum circuit breaker wear, the contacts lose thickness. For example, when an arc forms, a portion of the contact is degraded or damaged. Over time, this damage reduces the size/thickness of the contact. Thus, when moving into the second position, the movable contact must move further so as to make contact with the fixed contact. Generally, the elements of the operating mechanism are rigid. Thus, while the elements of the operating mechanism move between first and second positions, when the elements of the operating mechanism are in their first/second positions, the elements of the operating mechanism are disposed at a predetermined position relative to the elements of the circuit breaker assembly, e.g., the circuit breaker assembly housing assembly. That is, the elements of the operating mechanism do not change their positions and, as such, the movable contact cannot change its position as it wears. To accommodate the wear of the contacts, the operating mechanism includes a position adjustment assembly that is structured to adjust the position of the movable contact relative to the fixed contact. For example, in some embodiments, the position adjustment assembly includes a threaded rod to which the movable contact is coupled. As the contacts wear, the threaded rod is actuated so as to adjust to the position of the movable contact relative to the fixed contact (and other elements of the operating mechanism). This is a disadvantage in that a user must measure the contact wear and then manually actuate the position adjustment assembly.

There is, therefore, a need for an operating mechanism for a circuit breaker assembly wherein the operating mechanism includes an opening, first actuator assembly and a closing, second actuator assembly and wherein the first and second actuators are split. That is, actuation of at least one actuator does not cause elements of the other actuator to move. There is a further need for an operating mechanism for a circuit breaker assembly wherein the operating mechanism elements are structured to be sufficiently robust for the life cycle of the operating mechanism (or an actuator of the operating mechanism) wherein the operating mechanism (or an actuator of the operating mechanism) is less hardy than the prior art operating mechanism (or an actuator of the operating mechanism) because the characteristics of the contact (the "[X] characteristics") are less than the contact characteristics of the prior art.

SUMMARY OF THE INVENTION

These needs, and others, are met by at least one embodiment of this invention which provides an operating mechanism for a circuit breaker assembly, the operating mechanism including an opening, first actuator assembly and a closing, second actuator assembly. The first actuator assembly is structured to operatively engage at least one movable contact and is structured to move the at least one movable contact from a first configuration to a second configuration. The second actuator assembly is structured to operatively engage the at least one movable contact and is structured to move the at least one movable contact from the second configuration to the first configuration. The first actuator assembly and the second actuator assembly are split cooperative actuator assemblies.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
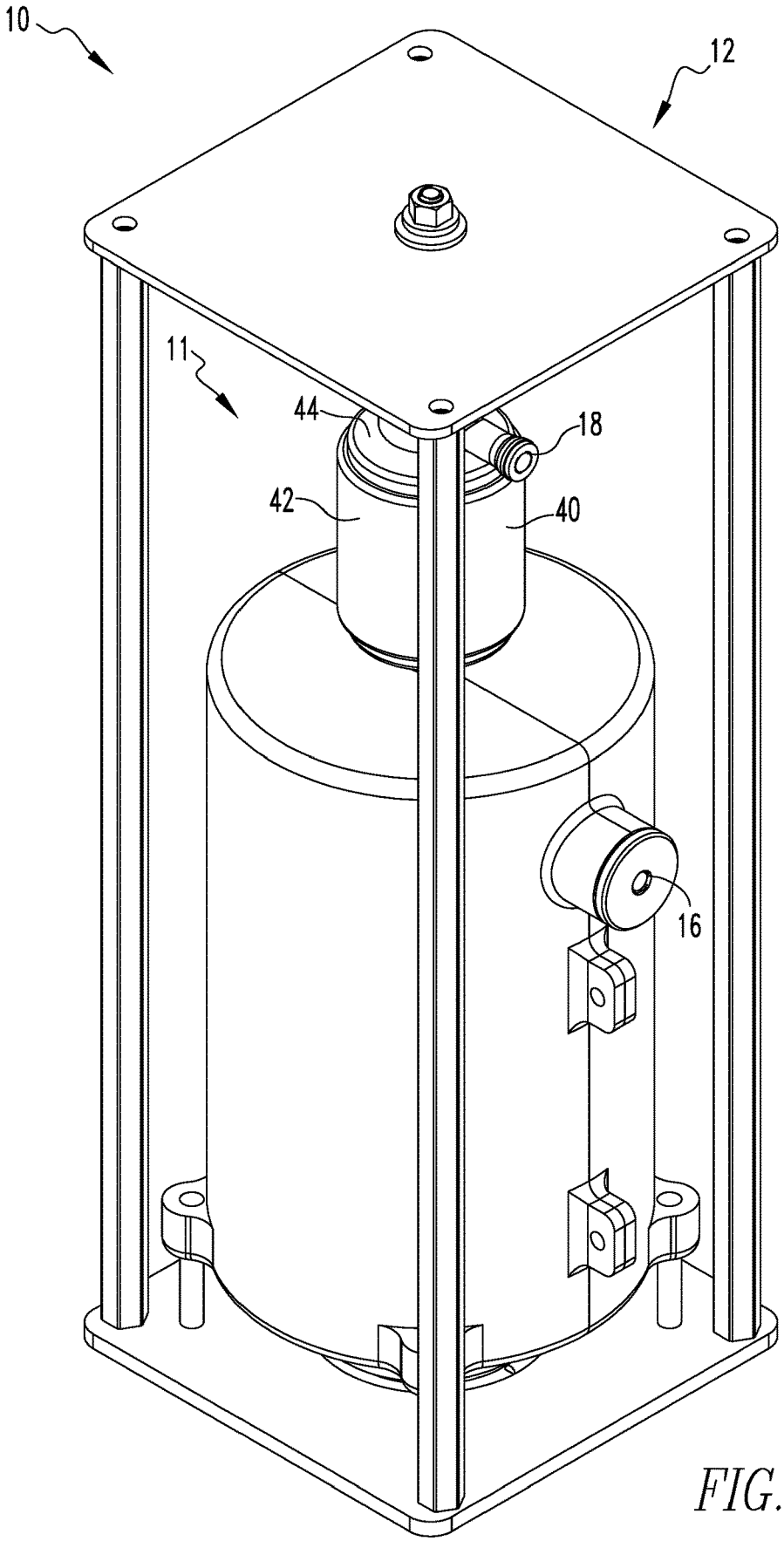
FIG. 1 is an isometric view of a circuit breaker assembly.

It will be appreciated that the specific elements illustrated in the figures herein and described in the following specification are simply exemplary embodiments of the disclosed concept, which are provided as non-limiting examples solely for the purpose of illustration. Therefore, specific dimensions, orientations, assembly, number of components used, embodiment configurations and other physical characteristics related to the embodiments disclosed herein are not to be considered limiting on the scope of the disclosed concept.

Directional phrases used herein, such as, for example, clockwise, counterclockwise, left, right, top, bottom, upwards, downwards and derivatives thereof, relate to the orientation of the elements shown in the drawings and are not limiting upon the claims unless expressly recited therein.

As used herein, the singular form of "a," "an," and "the" include plural references unless the context clearly dictates otherwise.

As used herein, "structured to [verb]" means that the identified element or assembly has a structure that is shaped, sized, disposed, coupled and/or configured to perform the identified verb. For example, a member that is "structured to move" is movably coupled to another element and includes elements that cause the member to move or the member is otherwise configured to move in response to other elements or assemblies. As such, as used herein, "structured to [verb]" recites structure and not function. Further, as used herein, "structured to [verb]" means that the identified element or assembly is intended to, and is designed to, perform the identified verb. Thus, an element that is merely capable of performing the identified verb but which is not intended to, and is not designed to, perform the identified verb is not "structured to [verb]."

As used herein, "associated" means that the elements are part of the same assembly and/or operate together, or, act upon/with each other in some manner. For example, an automobile has four tires and four hubcaps. While all the elements are coupled as part of the automobile, it is understood that each hubcap is "associated" with a specific tire.

As used herein, a "coupling assembly" includes two or more couplings or coupling components. The components of a coupling or coupling assembly are generally not part of the same element or other component. As such, the components of a "coupling assembly" may not be described at the same time in the following description.

As used herein, a "coupling" or "coupling component(s)" is one or more component(s) of a coupling assembly. That is, a coupling assembly includes at least two components that are structured to be coupled together. It is understood that the components of a coupling assembly are compatible with each other. For example, in a coupling assembly, if one coupling component is a snap socket, the other coupling component is a snap plug, or, if one coupling component is a bolt, then the other coupling component is a nut or threaded bore.

As used herein, the statement that two or more parts or components are "coupled" shall mean that the parts are joined or operate together either directly or indirectly, i.e., through one or more intermediate parts or components, so long as a link occurs. As used herein, "directly coupled" means that two elements are directly in contact with each other. As used herein, "fixedly coupled" or "fixed" means that two components are coupled so as to move as one while maintaining a constant orientation relative to each other. Accordingly, when two elements are coupled, all portions of those elements are coupled. A description, however, of a specific portion of a first element being coupled to a second element, e.g., an axle first end being coupled to a first wheel, means that the specific portion of the first element is disposed closer to the second element than the other portions thereof. Further, an object resting on another object held in place only by gravity is not "coupled" to the lower object unless the upper object is otherwise maintained substantially in place. That is, for example, a book on a table is not coupled thereto, but a book glued to a table is coupled thereto.

As used herein, the phrase "removably coupled" or "temporarily coupled" means that one component is coupled with another component in an essentially temporary manner. That is, the two components are coupled in such a way that the joining or separation of the components is easy and would not damage the components. For example, two components secured to each other with a limited number of readily accessible fasteners, i.e., fasteners that are not difficult to access, are "removably coupled" whereas two components that are welded together or joined by difficult to access fasteners are not "removably coupled." A "difficult to access fastener" is one that requires the removal of one or more other components prior to accessing the fastener wherein the "other component" is not an access device such as, but not limited to, a door.

As used herein, "temporarily disposed" means that a first element(s) or assembly (ies) is resting on a second element (s) or assembly(ies) in a manner that allows the first element/assembly to be moved without having to decouple or otherwise manipulate the first element. For example, a book simply resting on a table, i.e., the book is not glued or fastened to the table, is "temporarily disposed" on the table.

As used herein, "operatively coupled" means that a number of elements or assemblies, each of which is movable between a first position and a second position, or a first configuration and a second configuration, are coupled so that as the first element moves from one position/configuration to the other, the second element moves between positions/configurations as well. It is noted that a first element may be "operatively coupled" to another without the opposite being true.

As used herein, a "fastener" is a separate component structured to couple two or more elements. Thus, for example, a bolt is a "fastener" but a tongue-and-groove coupling is not a "fastener." That is, the tongue-and-groove elements are part of the elements being coupled and are not a separate component.

As used herein, "correspond" indicates that two structural components are sized and shaped to be similar to each other and may be coupled with a minimum amount of friction. Thus, an opening which "corresponds" to a member is sized slightly larger than the member so that the member may pass through the opening with a minimum amount of friction.

This definition is modified if the two components are to fit "snugly" together. In that situation, the difference between the size of the components is even smaller whereby the amount of friction increases. If the element defining the opening and/or the component inserted into the opening are made from a deformable or compressible material, the opening may even be slightly smaller than the component being inserted into the opening. With regard to surfaces, shapes, and lines, two, or more, "corresponding" surfaces, shapes, or lines have generally the same size, shape, and contours. With regard to elements/assemblies that are movable or configurable, "corresponding" means that when elements/assemblies are related and that as one element/assembly is moved/reconfigured, then the other element/assembly is also moved/reconfigured in a predetermined manner. For example, a lever including a central fulcrum and elongated board, i.e., a "see-saw" or "teeter-totter," the board has a first end and a second end. When the board first end is in a raised position, the board second end is in a lowered position. When the board first end is moved to a lowered position, the board second end moves to a "corresponding" raised position. Alternately, a cam shaft in an engine has a first lobe operatively coupled to a first piston. When the first lobe moves to its upward position, the first piston moves to a "corresponding" upper position, and, when the first lobe moves to a lower position, the first piston, moves to a "corresponding" lower position.

As used herein, a "path of travel" or "path," when used in association with an element that moves, includes the space an element moves through when in motion. As such, any element that moves inherently has a "path of travel" or "path." Further, a "path of travel" or "path" relates to a motion of one identifiable construct as a whole relative to another object. For example, assuming a perfectly smooth road, a rotating wheel (an identifiable construct) on an automobile generally does not move relative to the body (another object) of the automobile. That is, the wheel, as a whole, does not change its position relative to, for example, the adjacent fender. Thus, a rotating wheel does not have a "path of travel" or "path" relative to the body of the automobile. Conversely, the air inlet valve on that wheel (an identifiable construct) does have a "path of travel" or "path" relative to the body of the automobile. That is, while the wheel rotates and is in motion, the air inlet valve, as a whole, moves relative to the body of the automobile.

As used herein, the statement that two or more parts or components "engage" one another means that the elements exert a force or bias against one another either directly or through one or more intermediate elements or components. Further, as used herein with regard to moving parts, a moving part may "engage" another element during the motion from one position to another and/or may "engage" another element once in the described position. Thus, it is understood that the statements, "when element A moves to element A first position, element A engages element B," and "when element A is in element A first position, element A engages element B" are equivalent statements and mean that element A either engages element B while moving to element A first position and/or element A engages element B while in element A first position.

As used herein, "operatively engage" means "engage and move." That is, "operatively engage" when used in relation to a first component that is structured to move a movable or rotatable second component means that the first component applies a force, directly or indirectly, sufficient to cause the second component to move. For example, a screwdriver may be placed into contact with a screw. When no force is applied to the screwdriver, the screwdriver is merely "temporarily coupled" to the screw. If an axial force is applied to the screwdriver, the screwdriver is pressed against the screw and "engages" the screw. However, when a rotational force is applied to the screwdriver, the screwdriver "operatively engages" the screw and causes the screw to rotate. Further, with components controlled by electricity, "operatively engage" also means that one component controls another component by a control signal or current.

As used herein, the word "unitary" means a component that is created as a single piece or unit. That is, a component that includes pieces that are created separately and then coupled together as a unit is not a "unitary" component or body.

As used herein, the term "number" shall mean one or an integer greater than one (i.e., a plurality). That is, for example, the phrase "a number of elements" means one element or a plurality of elements. It is specifically noted that the term "a 'number' of [N]" includes a single [N].

As used herein, in the phrase "[a] moves between its first position and second position," or, "[b] is structured to move [a] between its first position and second position," "[a]" is the name of an element or assembly. Further, when [a] is an element or assembly that moves between a number of positions, the pronoun "its" means "[a]," i.e., the named element or assembly that precedes the pronoun "its."

As used herein, "in electronic communication" is used in reference to communicating a signal via an electromagnetic wave or signal. "In electronic communication" includes both hardline and wireless forms of communication; thus, for example, a "data transfer" or "communication method" via a component "in electronic communication" with another component means that data is transferred from one computer to another computer (or from one processing assembly to another processing assembly) by physical connections such as USB, Ethernet connections or remotely such as NFC, blue tooth, etc. and should not be limited to any specific device.

As used herein, "in electric communication" means that a current passes, or can pass, between the identified elements. Being "in electric communication" is further dependent upon an element's position or configuration. For example, in a circuit breaker, a movable contact is "in electric communication" with the fixed contact when the contacts are in a closed position. The same movable contact is not "in electric communication" with the fixed contact when the contacts are in the open position.

As used herein, a "radial side/surface" for a circular or cylindrical body is a side/surface that extends about, or encircles, the center thereof or a height line passing through the center thereof. As used herein, an "axial side/surface" for a circular or cylindrical body is a side that extends in a plane extending generally perpendicular to a height line passing through the center. That is, generally, for a cylindrical soup can, the "radial side/surface" is the generally circular sidewall and the "axial side(s)/surface(s)" are the top and bottom of the soup can. Further, as used herein, "radially extending" means extending in a radial direction or along a radial line. That is, for example, a "radially extending" line extends from the center of the circle or cylinder toward the radial side/surface. Further, as used herein, "axially extending" means extending in the axial direction or along an axial line. That is, for example, an "axially extending" line extends from the bottom of a cylinder toward the top of the cylinder and substantially parallel to, or along, a central longitudinal axis of the cylinder.

As used herein, "generally curvilinear" includes elements having multiple curved portions, combinations of curved portions and planar portions, and a plurality of linear/planar portions or segments disposed at angles relative to each other thereby forming a curve.

As used herein, an "elongated" element inherently includes a longitudinal axis and/or longitudinal line extending in the direction of the elongation.

As used herein, "about" in a phrase such as "disposed about [an element, point or axis]" or "extend about [an element, point or axis]" or "[X] degrees about an [an element, point or axis]," means encircle, extend around, or measured around. When used in reference to a measurement or in a similar manner, "about" means "approximately," i.e., in an approximate range relevant to the measurement as would be understood by one of ordinary skill in the art.

As used herein, "generally" means "in a general manner" relevant to the term being modified as would be understood by one of ordinary skill in the art.

As used herein, "substantially" means "by a large amount or degree" relevant to the term being modified as would be understood by one of ordinary skill in the art.

As used herein, "at" means on and/or near relevant to the term being modified as would be understood by one of ordinary skill in the art.

As used herein, to move an element "rapidly" (or to "rapidly" move an element) means that the element moves between two designated configurations/positions in less than 10 ms. As used herein, to move an element "very rapidly" (or to "very rapidly" move an element) means that the element moves between two designated configurations/positions in less than 5 ms. As used herein, to move an element "exceedingly rapidly" (or to "exceedingly rapidly" move an element) means that the element moves between two designated configurations/positions in less than 2 ms.

As used herein, an "actuator" or "actuator assembly" means an element, or an assembly with a plurality of elements, that move(s) between positions/configurations and which causes a motion in, or applies bias to, a final "actuated element." That is, the "actuator" is an element/assembly to which energy is applied and which acts on a final "actuated element." Stated alternately, other than the energy/force applied by the "actuator," no energy that generates a motion/bias is applied to an "actuated element." Further, as used herein, an "actuator" inherently has an "actuated element." As an example, in a mousetrap having a base that supports a spring and trap bar, the spring is the "actuator" and the trap bar is the "actuated element." As another example, in an isolated solenoid assembly (i.e., a solenoid assembly that is not coupled to another element), the coil that is energized is the "actuator" and the plunger is the "actuated element." Conversely, when a solenoid assembly is coupled to another element, i.e., the plunger is coupled to a movable element, the solenoid assembly as a whole is the "actuator" and the movable element is the "actuated element." That is, in certain embodiments, intermediate elements are disposed between the energized element and the final "actuated element." As used herein, such intermediate elements that transfer motion or bias are part of an "actuator" assembly and are not the "actuated element." Finally, in a circuit breaker assembly, the operating mechanism includes at least one actuator assembly and, as used herein, a movable contact is the "actuated element." In a configuration wherein an operating mechanism moves other elements that are neither part of the actuator assembly nor the movable contact, those elements are, as used herein, "secondary actuated elements."

Hereinafter, the terms "actuator" and "actuator assembly" are equivalent and both apply to both a unitary actuator (such as a spring) and actuator assemblies (such as a solenoid).

As used herein, "cooperative" actuator assemblies mean two or more actuator assemblies that act on the same "actuated element." Further, as used herein, "bi-directional cooperative" actuator assemblies mean two or more actuator assemblies that act on the same "actuated element" and wherein a first actuator assembly moves the actuated element from a first position to a second position (or applies a bias in a first direction) and a second actuator assembly moves the actuated element from the second position to the first position (or applies a bias in a second direction that is opposite, or different from, the first direction). Further, as used herein, "multi-directional cooperative" actuator assemblies means three or more actuator assemblies wherein a first actuator assembly moves the actuated element from a first position to a second position (or applies a bias in a first direction), a second actuator assembly moves the actuated element from the second position to a third position (or applies a bias in a second direction that is other than the first direction), and a third actuator assembly moves the actuated element from the second position to a third position or back to the first position (or applies a bias in a third direction that is other than the second direction). It is understood that if "multi-directional cooperative" actuator assemblies include more than three actuator assemblies, the additional actuator assemblies move the actuated element to additional positions (or apply bias in a direction that is different than the prior actuator acting on the actuated element).

As used herein, "split" cooperative actuator assemblies mean two or more actuator assemblies that act on the same "actuated element" wherein at least one of the actuator assemblies is not operatively coupled to the other. That is, the motion (or bias) generated by at least one actuator assembly is not imparted to the elements of the other cooperative actuator assembly(ies) in a substantial manner. Further, in some embodiments, "split" cooperative actuator assemblies include a configuration wherein both actuator assemblies are "independent." As used herein, "independent" split cooperative actuator assemblies are each operatively coupled to the same "actuated element" but are not operatively coupled to each other. "Split" cooperative actuator assemblies further include a configuration wherein one of the cooperative actuator assemblies is an "independent" split cooperative actuator assembly and wherein the other of the cooperative actuators is a "mutual" split cooperative actuator assembly. As used herein, a "mutual" split cooperative actuator assembly means a cooperative actuator that is operatively coupled to an element(s) of an "independent" split cooperative actuator assembly but the "independent" split cooperative actuator assembly is not operatively coupled to an element(s) of the "mutual" split cooperative actuator assembly. That is, in a configuration with one "independent" split cooperative actuator assembly and one "mutual" split cooperative actuator assembly, the "independent" split cooperative actuator assembly operatively engages an "actuated element" without operatively engaging any elements of the "mutual" split cooperative actuator assembly in a substantial manner. Conversely, while still a "split" cooperative actuator assembly as defined herein, the "mutual" split cooperative actuator assembly operatively engages the same "actuated element" as the "independent" split cooperative actuator assembly but also operatively engages at least one element of the "independent" split cooperative actuator assembly. Thus, when actuated, a "mutual" split cooperative actuator utilizes at least one element of the "independent" actuator assembly which is, as used herein, the "shared element(s)." That is, the "shared element(s)" are identified as part of the "mutual" split cooperative actuator when the "mutual" split cooperative actuator is in use. Conversely, during the operation of the "independent" split cooperative actuator assembly the "shared element(s)" are not identified as part of the "mutual" split cooperative actuator assembly. Stated alternately, the element of the "mutual" split cooperative actuator assembly is only identified as part of the "mutual" split cooperative actuator assembly when in use by the "mutual" split cooperative actuator assembly.

As used herein, an "initial gap" is a separation distance of about 1.5 mm between contacts. This gap is a sufficient distance to eliminate an arc.

As used herein, "opening [X] energy" means amount of energy required to move a movable contact with "[X] characteristics" from the second position to the first position. As used herein, "initial opening [X] energy" means amount of energy required to move a movable contact with "[X] characteristics" a sufficient separation distance relative to a fixed contact so as to extinguish an arc, i.e., the amount of energy required to move a movable contact to the initial gap. As used herein, "closing [X] energy" means amount of energy required to move a movable contact with "[X] characteristics" from the first position to the second position.

As discussed below, the disclosed and claimed concept allows for two movable contacts. Further, as discussed above, the kinetic energy of each moveable element is related to the square of velocity. When there are two movable contacts with "[X] characteristics," and when compared to a circuit breaker assembly with one movable contact with "[X] characteristics," the contacts only need to move half the distance and at half the speed to reach a sufficient separation distance so as to prevent an arc. Thus, as used herein "[½ X]" energy" means substantially half the amount of energy required to move a movable contact with "[X] characteristics" from the second position to the first position. The term "[½ X]" energy" is modified by the terms "opening," "initial opening," and "closing" as set forth above.

As used herein, a "life cycle" of a contact opening actuator assembly element means the length of time and/or number of actuations the contact opening actuator assembly element is structured to endure, as would be understood by those of skill in the art. That is, those of skill in the art know how to design and make "robust" elements of a contact opening actuator assembly for a movable contact with "[X] characteristics." Thus, as used herein, a "robust" contact opening actuator assembly means a contact opening actuator assembly wherein the elements have characteristics sufficient to withstand normal wear and tear for a "life cycle." Further, as used herein and given a movable contact with "[X] characteristics," an "[X] robust" contact opening actuator assembly means a contact opening actuator assembly having elements with characteristics sufficient to last a "life cycle" when associated with the movable contact with "[X] characteristics" and that requires "[X] energy" to move between positions. Stated alternately, and as used herein, a contact opening actuator assembly element with "[X] robustness" means a contact opening actuator assembly element having the characteristics sufficient to last a "life cycle" when associated with a movable contact with "[X] characteristics" and which requires "[X] energy" to move between first and second positions relative to a fixed contact, as would be understood by those of skill in the art.

As discussed in detail below, when there are two movable contacts, each movable contact only has to move at half the velocity and half the distance to move between the second and first positions. Thus, when the contacts have "[X] characteristics," the sum of kinetic energy of the movable contacts, each moving at half the velocity and half the distance, is 50% less than a full velocity contact with "[X] characteristics" moving between the second and first positions. That is, when there are two movable contacts with "[X] characteristics," only "[½ X]" kinetic energy" is required to move the movable contacts between the second and first positions, with a high final velocity.

That is, in order to minimize the arc created as the contacts separate, the contacts must move with a minimum initial velocity. Generally, the higher the initial velocity of the contacts, the higher the final velocity as the contacts move into the second position, i.e., when fully separated. As the initial and final velocity changes depending upon the characteristics of the circuit breaker, the opening actuator and the contacts, the term "high velocity," defined below, is a function/comparison of the contact's kinetic energy relative to the contact's potential energy. In an embodiment wherein the opening actuator includes a Thomson coil 104, discussed below, the kinetic energy and contacts' potential energy are a function of the size of the Thomson coil 104 (shown as a diameter), the size of the Thomson coil armature 106 (discussed below and shown as a diameter), the weight of the contacts 20', 20", and the capacitor voltage for the Thomson coil 104.

That is, the input energy (Ei) is equal to the Kinetic energy (Ek=0.5 m v^2)+the Potential energy (Ep=0.5 k x^2) . . . Ei=Ek+Ep=0.5 m v^2+0.5 k x^2. In an exemplary embodiment, the velocity of the contacts 20', 20" is a function of the capacitor charge as shown in the table below.

Plate Diameter = 5.000 inch
Coil Diameter = 5.000 inch
Moving Mass = 1.5 kg (Nate, Conductor, Contact)

| | at gap = 1.5 mm (Initial Gap) | | | | at gap = 10 mm (Final Gap) | | | |
|---|---|---|---|---|---|---|---|---|
| Capacitor Voltage Volts | Travel Time m-sec | Velocity m/s | Kinetic Energy J | Potential Energy J | Travel Time sec | Velocity m/s | Kinetic Energy J | Potential Energy J |
| 76 | 0.828 | 2.6 | 5.1 | 0.75 | 6.100 | 0.6 | 0.2 | 5.00 |
| 80 | 0.768 | 2.9 | 6.5 | 0.75 | 4.500 | 1.5 | 1.7 | 5.00 |
| 90 | 0.657 | 3.8 | 11.1 | 0.75 | 3.100 | 3.0 | 6.5 | 5.00 |
| 120 | 0.480 | 6.7 | 33.6 | 0.75 | 1.700 | 6.8 | 34.7 | 5.00 |
| 150 | 0.393 | 9.3 | 65.3 | 0.76 | 1.200 | 11.2 | 93.6 | 5.00 |
| 200 | 0.313 | 13.2 | 130.0 | 0.75 | 0.770 | 20.0 | 300.0 | 5.01 |

A "high" velocity is the velocity of the movable contacts 20', 20" as they move into the first position and when the kinetic energy is at least five times greater than the potential energy. Thus, if the final velocity is high, the final kinetic energy is much larger than the final potential energy, and the reduction of total energy (kinetic+potential) allows for smaller, or "minimally robust" elements of the movable contact actuator. As used herein, a "high" velocity means a velocity greater than about 1 m/s. Further, as used herein, a "very high" velocity means a velocity greater than about 5 m/s. If the velocity of the movable contacts decelerates to the final fully open position, the final potential energy is much larger than the final kinetic energy, and there is no reduction of the total energy (kinetic+potential) supplied to the system. Thus, as used herein, a "minimally robust" contact opening actuator assembly means a contact opening actuator assembly wherein the elements of the contact opening actuator assembly have characteristics sufficient to withstand normal wear and tear for a "life cycle" of the contact opening actuator assembly wherein the movable contact with "[X] characteristics" only requires "[½ X]" kinetic energy" to move from the second position to the first position with a high final velocity. That is, "minimally robust" contact opening actuator assembly elements structured to move a movable contact with [X] characteristics at half the velocity and half the distance are generally thinner/smaller for a high final velocity compared to contact opening actuator assembly elements structured to move a single movable contact with [X] characteristics at full velocity between the second and first positions. However, if the velocity of the movable contacts decelerates to the final fully open position, the final potential energy is much larger than the final kinetic energy, and there is no reduction of the total energy (kinetic+potential) for the system.

As used herein, "magnetic" means either a permanent magnet/electromagnet and/or a ferromagnetic construct associated with a magnet. Thus, for example, a plurality of "magnetic" members may include all permanent magnets or a combination of at least one permanent magnet and other ferromagnetic members.

As used herein, the terms "electromagnetic field" and "magnetic field" are interchangeable. That is, the difference in the terms refers to the source of the field and not to the effect of the field on other elements or other fields.

As used herein, a magnetic element is "effectively within an electromagnetic field" when the distance between a magnetic element and the source of the electromagnetic field is sufficient so that the magnetic element is maintained at a specific location.

As used herein, an "effective distance" for a construct that generates an electromagnetic field means a distance wherein the electromagnetic field has more than a negligible effect on magnetic element(s) or another electromagnetic field. For example, when a magnet is near an iron ball the iron ball moves toward the magnet, the magnet is an "effective distance" from the iron ball. As a further example, a construct that generates an electromagnetic field intended to weaken or disrupt another electromagnetic field is an "effective distance" from the other electromagnetic field if the generated electromagnetic field weakens or disrupts the other electromagnetic field. That is, the other magnetic field is weakened more than a negligible amount. As used herein, to "weaken" a magnetic field means that the strength of a magnetic field is reduced but not eliminated or substantially eliminated. As used herein, to "disrupt" a magnetic field means that the magnetic field is reduced to no strength or a negligible strength.

As used herein, "automatic" means a construct that operates without human input/action. A construct is "automatic" even if it needs a human to initially set it up or install it and/or perform maintenance or calibration so long as the construct generally performs without human input/action.

As used herein, "float," and variations thereof, e.g., "floating," "floatably," etc., means that an element is not coupled to another element in a rigid manner or a rotatable manner. For example, in a syringe, a plunger is "floatably" coupled to the barrel. That is, the plunger moves within the barrel and is maintained therein primarily by friction. Conversely, in a combustion engine, while a piston is movably disposed in a piston chamber, the piston is rotatably coupled to a piston rod. Thus, such a piston is not a "floating" construct. It is noted that a "floating" construct may be guided or have its range of motion limited.

As used herein, a "contact adjustment location" means a location relative to a circuit breaker assembly including a fixed contact and a movable contact as well as a first actuator assembly and/or a second actuator assembly wherein a force acting along a line passing through the movable contact and the first actuator assembly and/or the second actuator assembly biases the movable contact toward the fixed contact.

Figure 4:
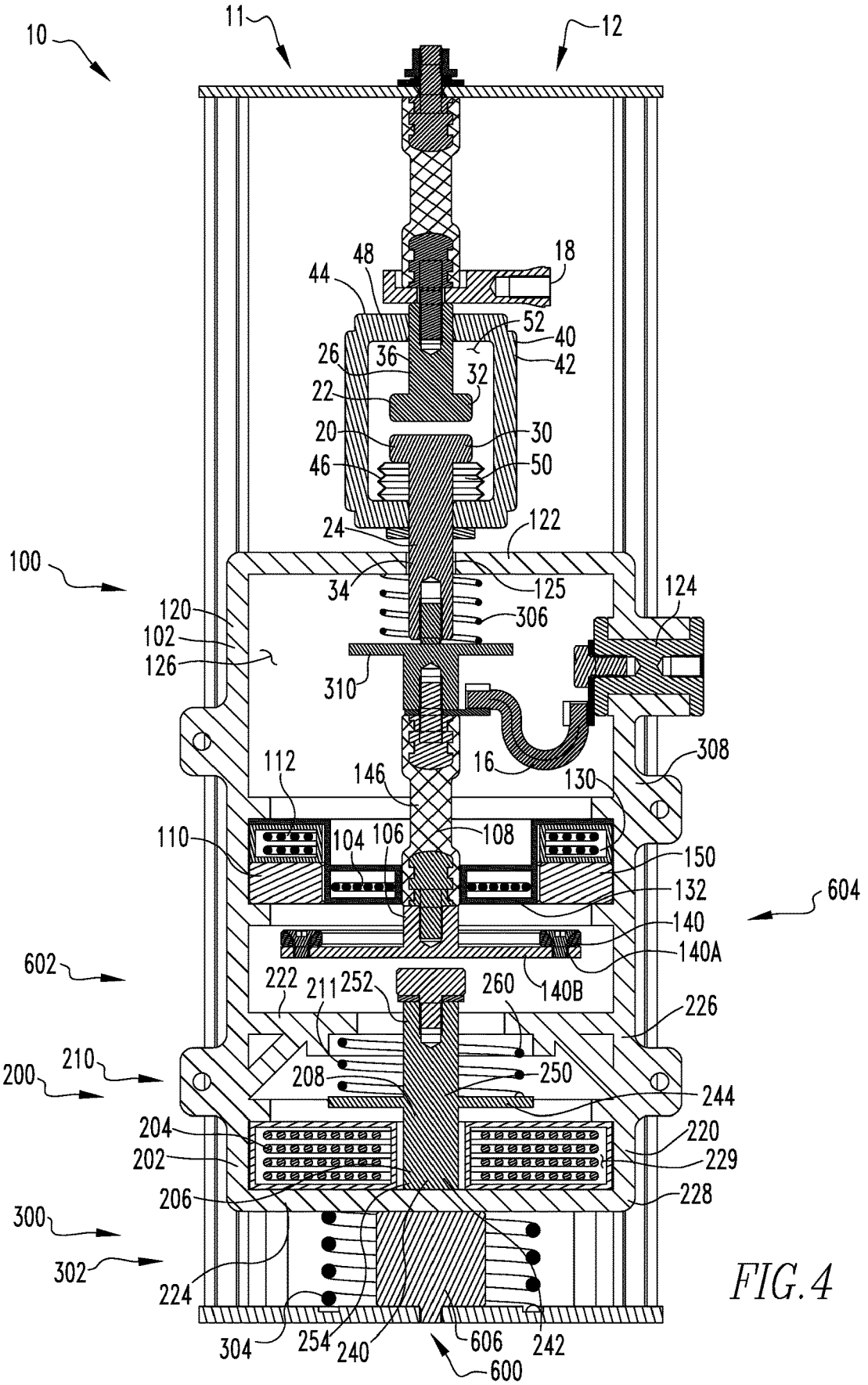
FIG. 4 is a partially schematic side cross-sectional view of a circuit breaker assembly including split cooperative actuator assemblies with a movable contact in an open, first configuration.

As shown in FIGS. 1-4, a circuit breaker assembly 10 includes, among other elements, a conductor assembly 12 and an operating mechanism 14. Other elements, not shown, include a housing assembly, a control assembly, a trip assembly, and terminals structured to be coupled to a line and a load. The conductor assembly 12 includes a load conductor 16, a line conductor 18, at least one movable contact 20 (FIG. 4) and, in an exemplary embodiment, a stationary, or fixed contact 22 (FIG. 4). In one exemplary embodiment, there is one movable contact 20. The load conductor 16 is structured to be, and is, coupled to, and in electrical communication with, a load terminal (not shown) that is in further electrical communication with a load. The line conductor 18 is structured to be, and is, coupled to, and in electrical communication with, a line terminal (not shown) that is in further electrical communication with a line. The load conductor 16 is also coupled to, and in electrical communication with, the movable contact 20. The line conductor 18 is also coupled to, and in electrical communication with, the fixed contact 22. The movable contact 20 is structured to, and does, move between a first configuration, wherein the movable contact 20 is spaced from, and not in electrical communication with, the fixed contact 22, and, a second configuration, wherein the movable contact 20 is coupled or directly coupled to, and in electrical communication with, the fixed contact 22. As is known, when the movable contact 20 is in the first configuration the circuit breaker assembly 10 is said to be "open" and electricity cannot flow therethrough. Conversely, when the movable contact 20 is in the second configuration the circuit breaker assembly 10 is said to be "closed" and electricity flows therethrough. Thus, the motion of the movable contact 20 from the second configuration to the first configuration is, as used herein, the "opening operation." Similarly, the motion of the movable contact 20 from the first configuration to the second configuration is, as used herein, the "closing operation." The operating mechanism 14 is structured to, and does, move the movable contact 20 between the first and second positions.

In an exemplary embodiment, the circuit breaker assembly 10 is a vacuum circuit breaker assembly 11. In this embodiment, as shown in FIGS. 2-5, the conductor assembly 12 further includes a movable contact stem 24 and a fixed contact stem 26. The movable contact 20 includes a generally disk-like body 30. Similarly, the fixed contact 22 includes a generally disk-like body 32. The movable contact stem 24 includes an elongated body 34 that, in an exemplary embodiment, is generally cylindrical. Similarly, the fixed contact stem 26 also includes an elongated body 36 that, in an exemplary embodiment, is generally cylindrical. The movable contact stem 24 is coupled, directly coupled, or fixed to, or is unitary with, the movable contact 20. Thus, the movable contact stem 24 is in electrical communication with the movable contact 20. The fixed contact stem 26 is coupled, directly coupled, or fixed to, or is unitary with, the fixed contact 22. Thus, the fixed contact stem 26 is in electrical communication with the fixed contact 22.

The vacuum circuit breaker assembly 11 further includes a vacuum chamber 40. The vacuum chamber 40 includes a sidewall 42, an end cap 44, and a bellows 46. In an exemplary embodiment, the vacuum chamber sidewall 42 is generally cylindrical and hollow. Further, the end cap 44 and the bellows 46 also have a generally circular cross-section. The end cap 44 includes a body 48 that defines a passage (not numbered) through which the movable contact stem 24 extends. The movable contact stem 24 is sealingly coupled to the end cap body 48. The perimeter of the end cap body 48 is sealingly coupled to one end of the vacuum chamber sidewall 42. The bellows 46 includes a body 50 that is structured to, and does, expand/contract in an accordion-like manner. The bellows body 50 also defines a passage, not numbered. The movable contact stem 24 extends through the bellows body 50 passage. The movable contact stem 24 is sealingly coupled to the bellows body 50. The bellows body 50 is sealingly coupled to the other end of the vacuum chamber sidewall 42. In this configuration, the vacuum chamber 40 defines an enclosed space 52. The movable contact 20 and the fixed contact 22 are disposed in the vacuum chamber enclosed space 52. As is known, atmosphere is drawn from the vacuum chamber 40 so that a substantial vacuum exists in the vacuum chamber enclosed space 52.

As noted above, the operating mechanism 14 is structured to, and does, move the movable contact 20 between the first and second positions. Further, as shown in the figures, the elements of the operating mechanism 14 are generally cylindrical or annular in shape. It is understood that this shape is exemplary. The operating mechanism 14 includes an opening, first actuator assembly 100 and a closing, second actuator assembly 200 (both shown schematically with certain elements not shown). The first actuator assembly 100 and the second actuator assembly 200 are split cooperative actuators. That is, both the first actuator assembly 100 and the second actuator assembly 200 operatively engage the movable contact 20 which is, in this embodiment, the actuated element. Further, as shown, the first actuator assembly 100 is an independent split cooperative actuator assembly while the second actuator assembly 200 is a mutual split cooperative actuator assembly. That is, the first actuator assembly 100 is structured to, and does, operatively engage the movable contact 20 but does not operatively engage any elements of the second actuator assembly 200. Conversely, the second actuator assembly 200 operatively engages at least one element of the first actuator assembly 100. This configuration solves the problem(s) noted above.

Further, the first actuator assembly 100 and the second actuator assembly 200 are, in an exemplary embodiment, split bi-directional cooperative actuator assemblies. That is, the movable contact 20 moves between a first configuration, or position, and a second configuration, or position. As shown, the first actuator assembly 100 is structured to, and does, move the movable contact 20 from the second configuration, or position, to the first configuration, or position. Conversely, the second actuator assembly 200 is structured to, and does, move the movable contact 20 from the first configuration, or position, to the second configuration, or position. Thus, the first actuator assembly 100 and the second actuator assembly 200 are split bi-directional cooperative actuator assemblies as defined above.

Further, because the first actuator assembly 100 is not structured to move elements of the second actuator assembly 200, the first actuator assembly 100 is structured to, and does, move the movable contact 20 rapidly, very rapidly, or exceedingly rapidly from the second configuration to the first configuration. That is, the first actuator assembly 100 is structured to, and does, move the movable contact 20 between the second configuration/position and the first configuration/position rapidly, very rapidly, or exceedingly rapidly. This solves the problem(s) above.

In an exemplary embodiment, the first actuator assembly 100 includes a housing assembly 102, a Thomson coil 104, a Thomson coil armature 106, and an elongated stem 108. In a further exemplary embodiment, the first actuator assembly 100 includes a latching magnet 110 and an unlatching coil 112 (shown schematically with certain elements not shown). The first actuator assembly housing assembly 102 includes a generally toroidal sidewall 120 and a radially extending, or axial, end member 122. In an exemplary embodiment, the first actuator assembly housing assembly sidewall 120 defines a port 124. In an exemplary embodiment, and as shown, the load conductor 16 extends through the port 124. The first actuator assembly housing assembly end member 122 further defines a passage or aperture 125 which is, in an exemplary embodiment, centrally disposed. The first actuator assembly housing assembly end member 122 is coupled, directly coupled, or fixed to the first actuator assembly housing assembly sidewall 120. The first actuator assembly housing assembly 102 defines a generally enclosed space 126.

The first actuator assembly Thomson coil 104 includes a body 130 that is generally an elongated conductor that is disposed in a spiral. As is known, the Thomson coil 104 is energized by a capacitor (not shown) that is in electrical communication with the Thomson coil 104. The first actuator assembly Thomson coil 104 is, in an exemplary embodiment, disposed in a protective material 132 such as, but not limited to, ceramic. As is known, the first actuator assembly Thomson coil 104 is structured to be, and is, in selective electrical communication with a power source (not shown). Thus, the first actuator assembly Thomson coil 104 is structured to, and does, selectively generate an electromagnetic (hereinafter, "EM") field.

The first actuator assembly Thomson coil armature 106 includes a magnetic body 140 which, in an exemplary embodiment, is a toriod body, i.e., a ring. The first actuator assembly Thomson coil armature 106 is coupled, directly coupled, or fixed to, or is unitary with, the first actuator assembly stem 108. In an exemplary embodiment, the first actuator assembly Thomson coil armature 106 is an assembly including a toroid magnetic body 140A and a conductive disk-like body 140B. The first actuator assembly Thomson coil armature toroid magnetic body 140A is disposed about the first actuator assembly Thomson coil armature conductive disk-like body 140B. The first actuator assembly Thomson coil armature toroid magnetic body 140A is coupled, directly coupled, or fixed to the first actuator assembly Thomson coil armature conductive disk-like body 140B.

The first actuator assembly stem 108 includes an elongated body 146 which, in an exemplary embodiment, is generally cylindrical. In an exemplary embodiment, the first actuator assembly stem 108 is coupled, directly coupled, or fixed to, or is unitary with the movable contact stem 24. Further, as shown, a conductor, which is shown as load conductor 16 is coupled, directly coupled, or fixed to, and is electrical communication with, the first actuator assembly stem 108.

The first actuator assembly latching magnet 110 includes a magnetic body 150 that generates a magnetic field. In an exemplary embodiment, the first actuator assembly latching magnet magnetic body 150 (hereinafter, and as used herein, the "first actuator assembly latching magnetic body") is generally toroidal. The first actuator assembly unlatching coil 112 includes a wire or similar construct, not numbered, that is structured to be, and is, selectively in electrical communication with a power source, not shown. The first actuator assembly unlatching coil 112 is generally toroidal. It is understood that the first actuator assembly unlatching coil 112 is structured to, and does, generate an EM field. Moreover, the first actuator assembly unlatching coil 112 is structured to, and does, generate a dampening EM field or a cancelation EM field. As used herein, a "dampening" EM field is an EM field that weakens, but does not fully disrupt, another EM field. As used herein, a "cancelation" EM field is an EM field that fully disrupts, another EM field.

Figure 2:
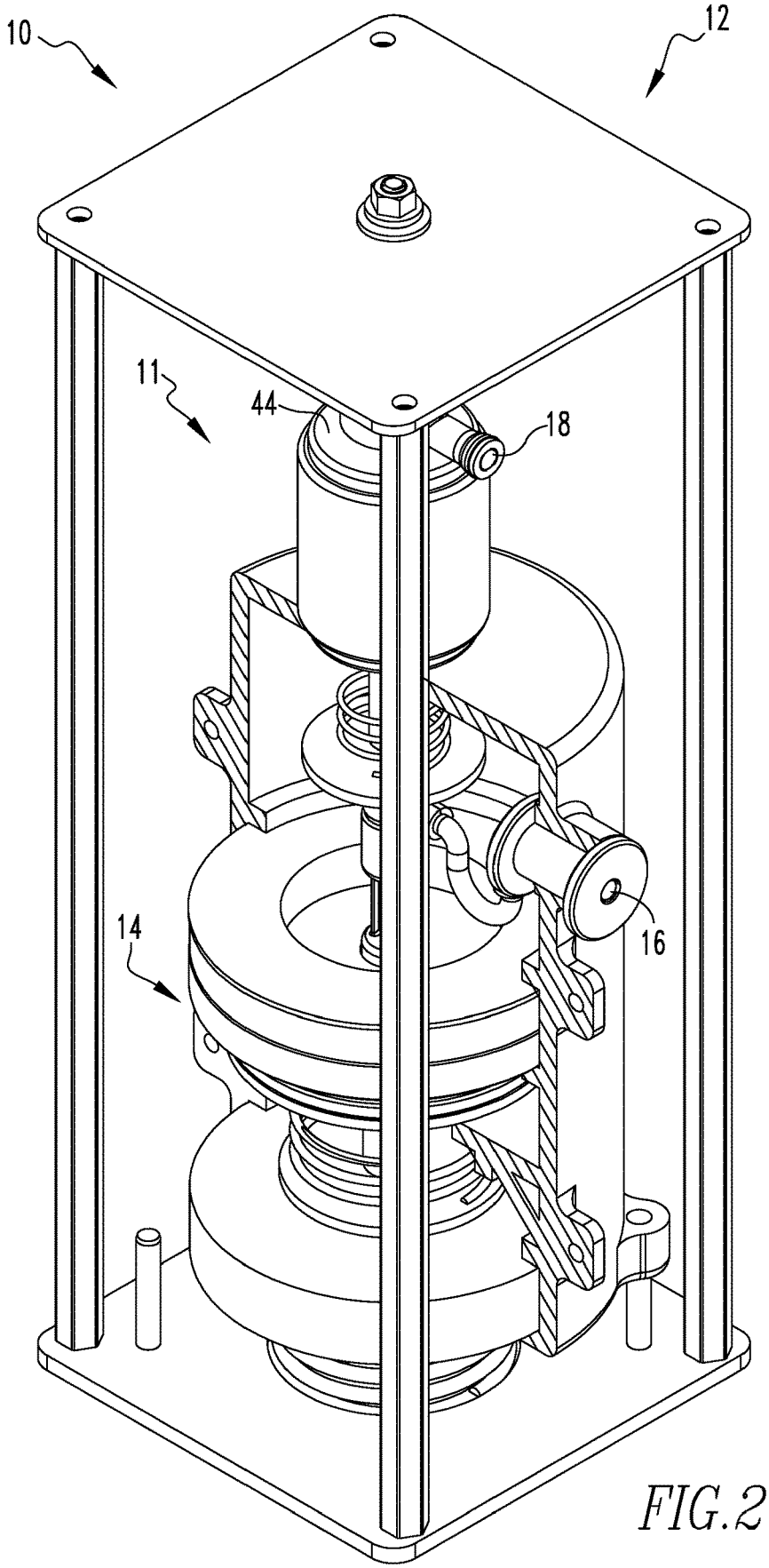
FIG. 2 is an isometric, partial cross-sectional view of a circuit breaker assembly.
Figure 3:
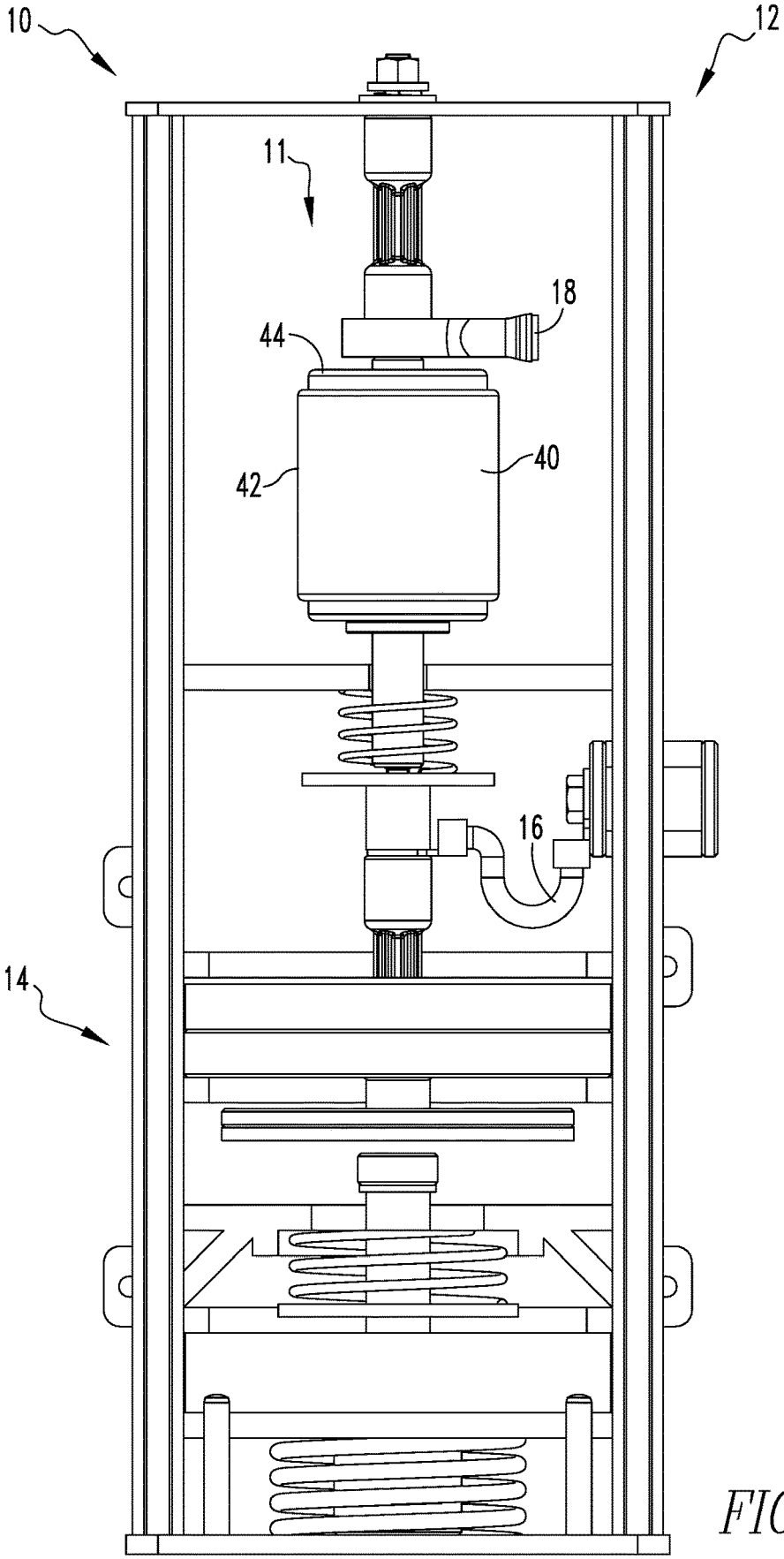
FIG. 3 is a partial cross-sectional side view of a circuit breaker assembly.

The first actuator assembly 100 is assembled as follows. The first actuator assembly stem 108 is coupled, directly coupled, or fixed to the first actuator assembly Thomson coil armature 106 with the axes thereof generally, or substantially, aligned or coextensive. The first actuator assembly latching magnet body 150 is coupled, directly coupled, or fixed to the inner surface of the first actuator assembly housing assembly 102. The first actuator assembly Thomson coil 104 is coupled, directly coupled, or fixed to the inner radial surface of the first actuator assembly latching magnet body 150. The first actuator assembly Thomson coil armature 106 is movably disposed in the first actuator assembly housing assembly 102 with the first actuator assembly stem 108 extending generally through the center of the first actuator assembly latching magnet body 150 and the first actuator assembly Thomson coil 104. The first actuator assembly Thomson coil armature 106 is disposed on the distal side, i.e., the side away from, the movable contact 20/the vacuum chamber 40 (the lower side as shown in FIG. 2). The first actuator assembly unlatching coil 112 is disposed an effective distance from the first actuator assembly latching magnet 110. That is, in one example, the first actuator assembly unlatching coil 112 is disposed immediately adjacent and above the first actuator assembly latching magnet 110. In a second exemplary embodiment, the first actuator assembly unlatching coil 112 is disposed outside of the first actuator assembly housing assembly 102 and about the first actuator assembly latching magnet 110. As shown, the longitudinal axes, not numbered, of the first actuator assembly stem 108 and the first actuator assembly housing assembly 102 are generally, or substantially, aligned with, or are coextensive with, the longitudinal axes, not numbered, of the movable contact stem 24 and the vacuum chamber 40.

Figure 5A:
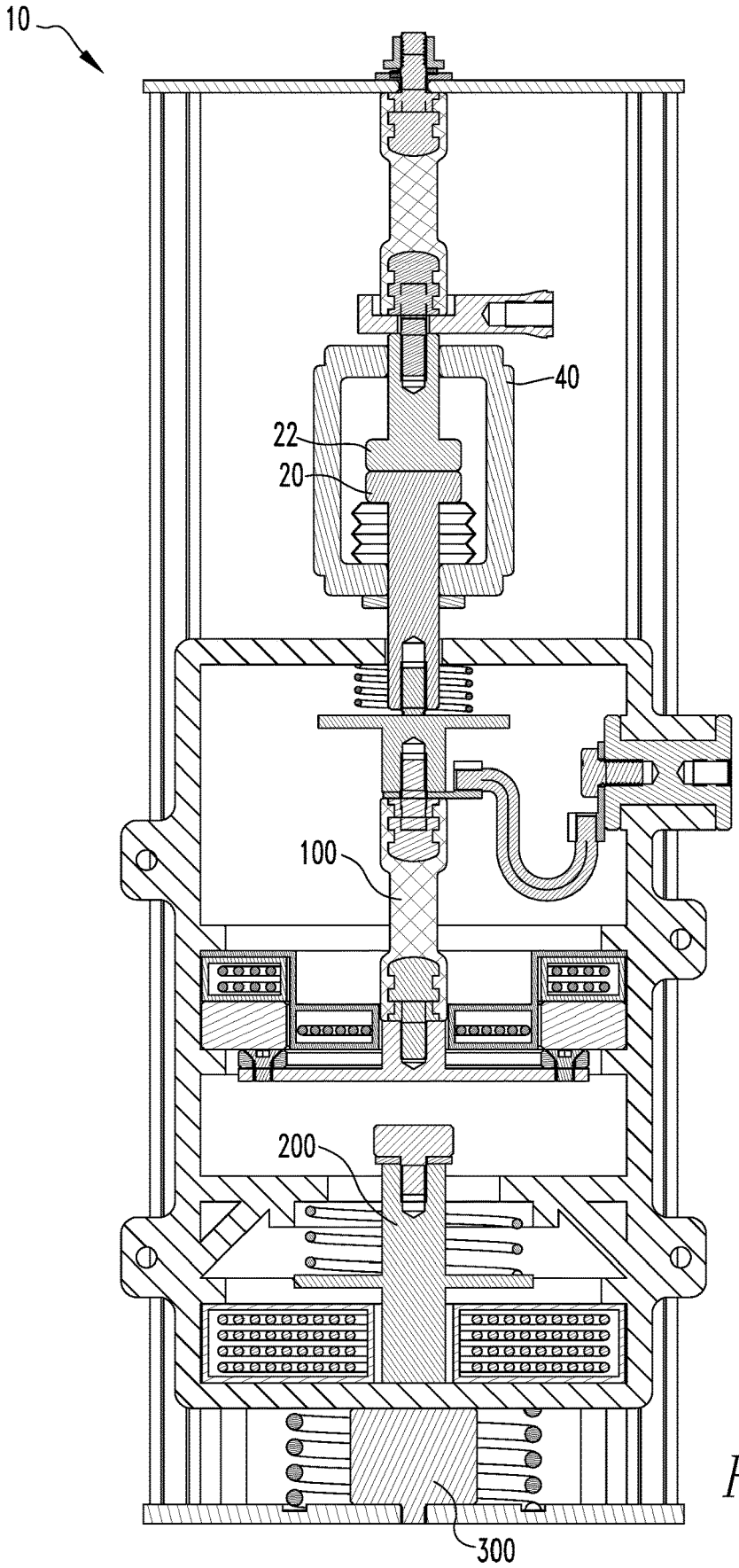
FIGS. 5A-5C are schematic side cross-sectional views of an operating mechanism including split cooperative actuator assemblies and an automatic contact position adjustment assembly showing the positions of various elements as a movable contact moves from the closed, second configuration (FIG. 5A) to the open, first configuration (FIG. 5C).
Figure 5B:
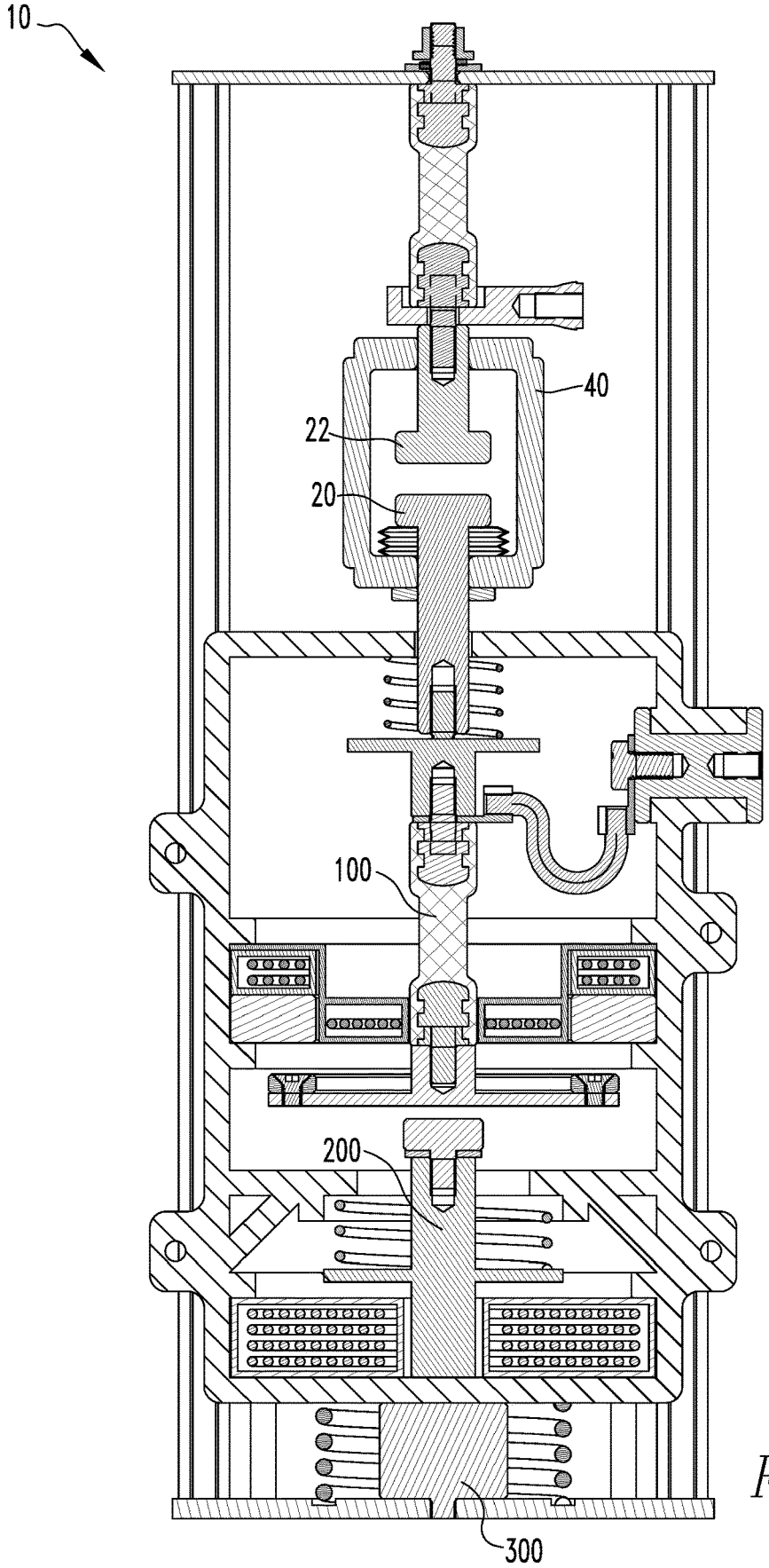
Figure 5C:
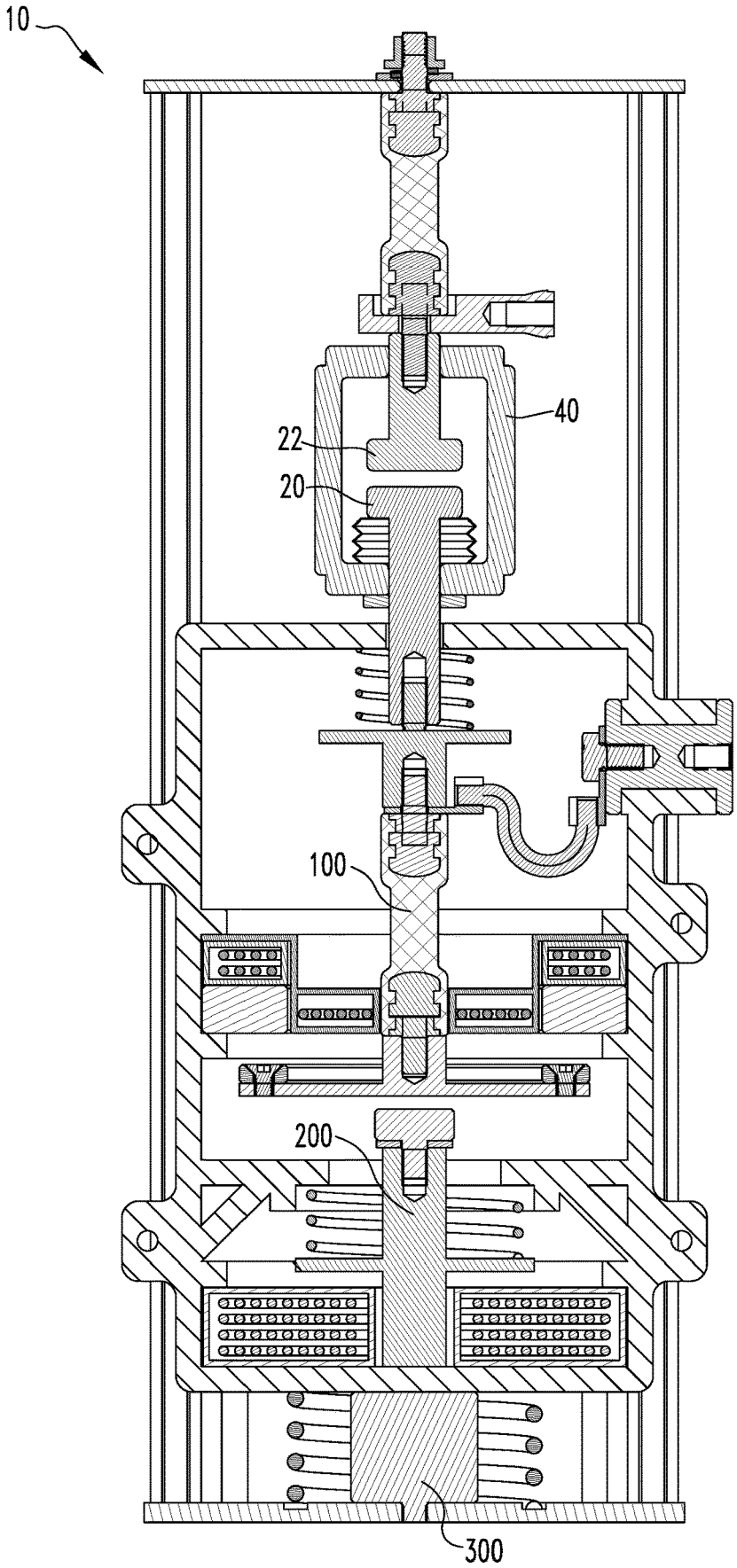
Figure 6A:
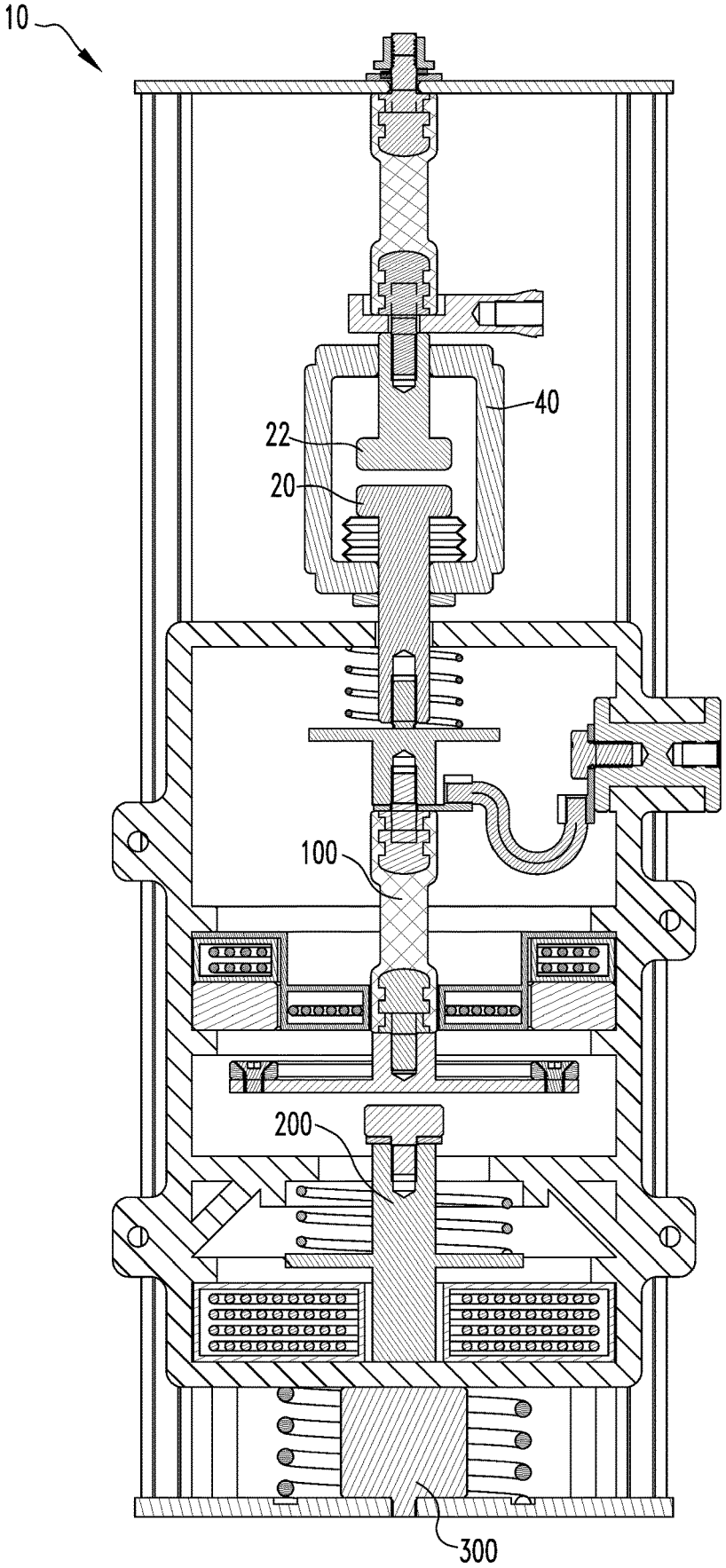
FIGS. 6A-6E are schematic side cross-sectional views of an operating mechanism including split cooperative actuator assemblies and an automatic contact position adjustment assembly showing the positions of various elements as a movable contact moves from the open, first configuration (FIG. 6A) to the closed, second configuration (FIG. 6E).
Figure 6B:
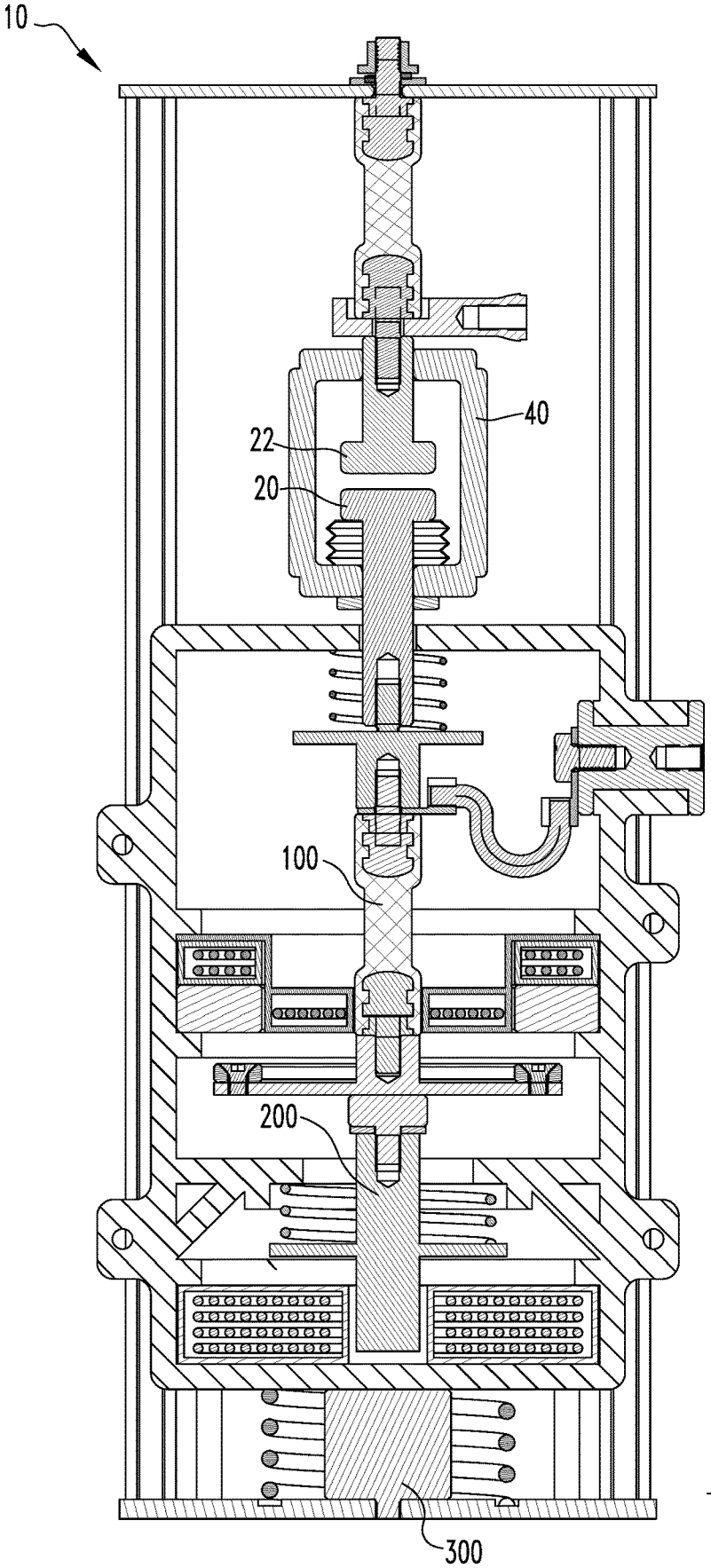
Figure 6C:
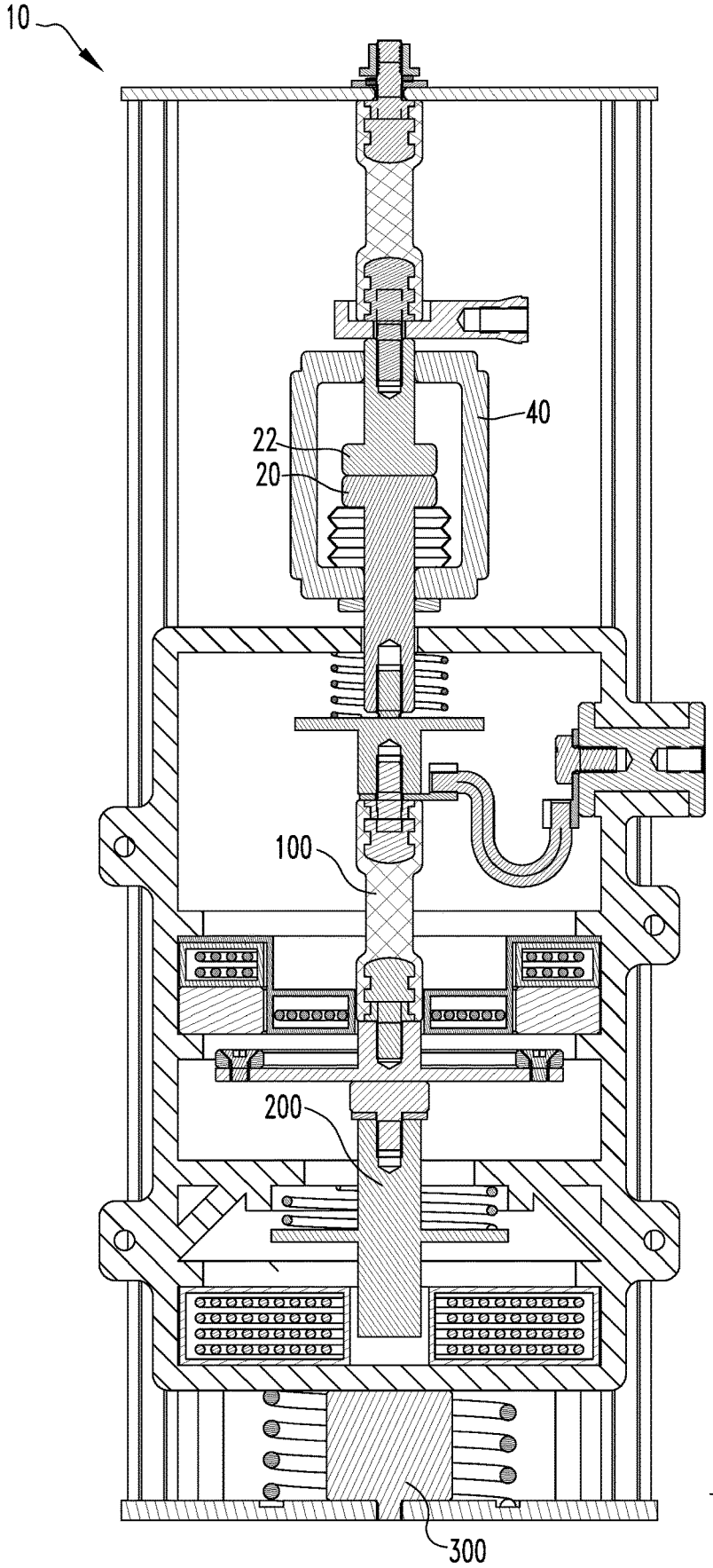
Figure 6D:
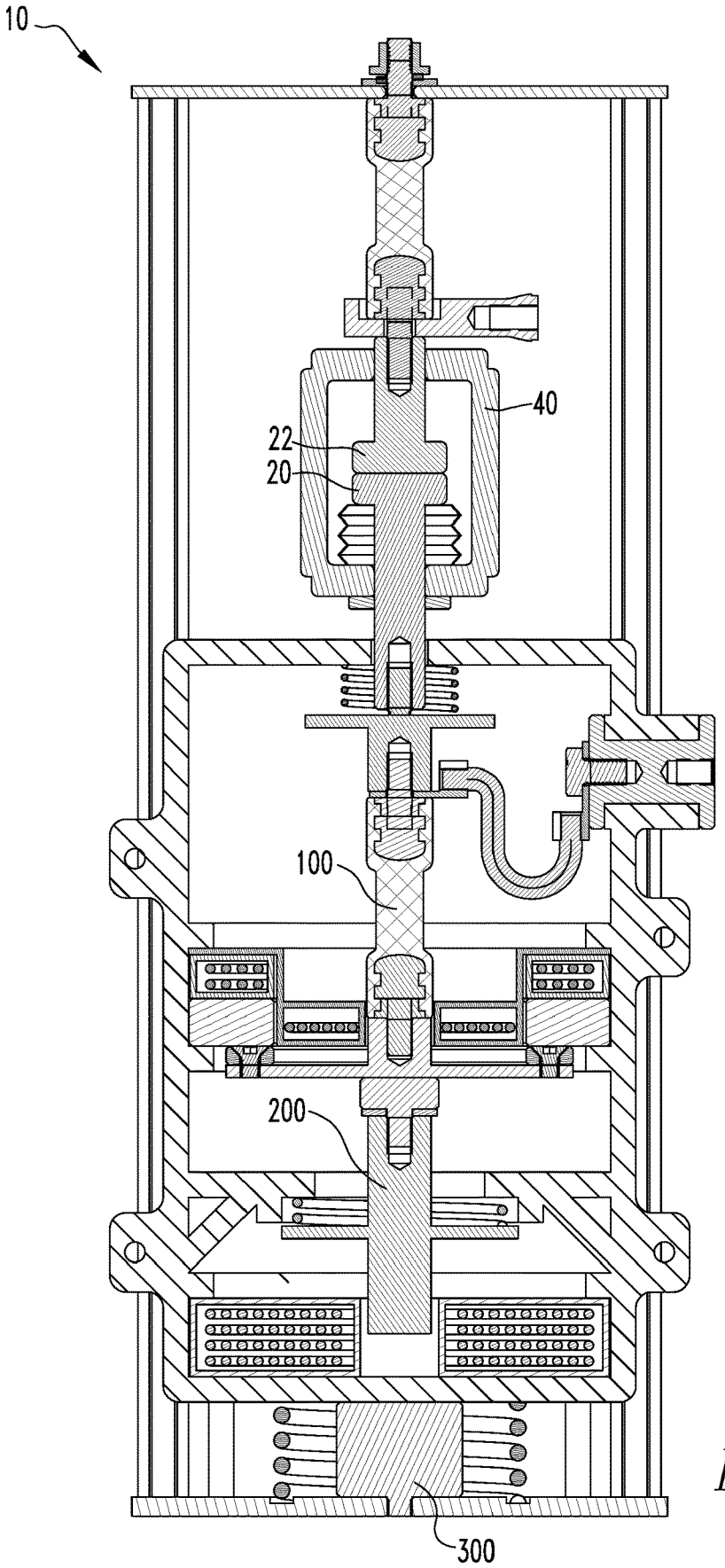
Figure 6E:
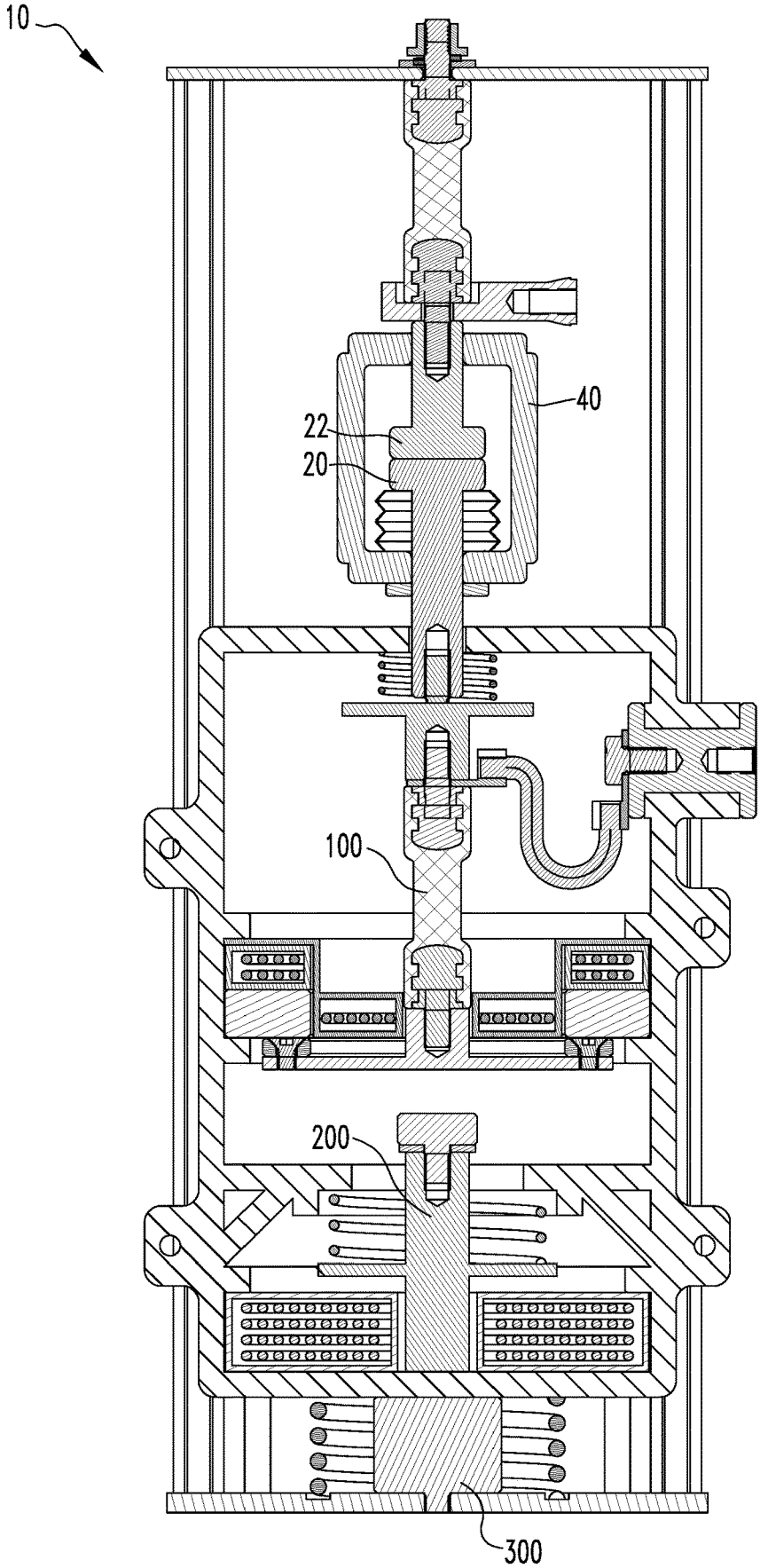

In this configuration, and as shown in FIGS. 5A-5C, the first actuator assembly 100 operates as follows. As this is an "opening" first actuator assembly 100, it is understood that the movable contact 20 is in the closed, second configuration initially. Thus, the elements of the first actuator assembly 100 are sized and positioned so that when the movable contact 20 is in the closed, second position, the first actuator assembly Thomson coil armature 106 is effectively within the first actuator assembly latching magnet's 110 electromagnetic field. In an exemplary embodiment, the first actuator assembly Thomson coil armature toroid magnetic body 140' is directly coupled to the first actuator assembly latching magnet 110. In this configuration, and without interference of the first actuator assembly latching magnet's 110 electromagnetic field, the first actuator assembly latching magnet 110 maintains the first actuator assembly Thomson coil armature 106 in this position which, hereinafter, is the first actuator assembly Thomson coil armature 106 second position. That is, the first actuator assembly latching magnet 110 has a sufficient strength to support the weight of the first actuator assembly Thomson coil armature 106 and elements coupled, directly coupled, or fixed thereto as well as any electromagnetic and/or spring forces that bias the movable contact 20 and the fixed contact 22 apart. Thus, the first actuator assembly 100 is also structured to maintain the movable contact 20 in the second position. That is, the first actuator assembly 100 is also a latch assembly.

When actuated, i.e., when the first actuator assembly Thomson coil 104 and the first actuator assembly unlatching coil 112 are energized, the following occurs. The first actuator assembly unlatching coil 112 generates a dampening EM field or a cancelation EM field. The first actuator assembly unlatching coil's dampening/cancelation EM field dampens/cancels the magnetic field of the first actuator assembly latching magnet 110. Simultaneously, or substantially simultaneously, the first actuator assembly Thomson coil 104 generates an EM field that is structured to, and does, repel the first actuator assembly Thomson coil armature 106. When the first actuator assembly Thomson coil armature 106 is repelled by the first actuator assembly Thomson coil 104, the first actuator assembly Thomson coil armature 106 and the elements coupled thereto move. That is, the first actuator assembly Thomson coil armature 106, and the elements coupled thereto, move between a second position and a first position corresponding to the configuration of the movable contact 20. That is, when the movable contact 20 is in the second configuration, the first actuator assembly Thomson coil armature 106, and the elements coupled thereto, are in their second positions, and, when the movable contact 20 is in the first configuration, the first actuator assembly Thomson coil armature 106, and the elements coupled thereto, are in their first positions. That is, when the first actuator assembly Thomson coil armature 106 is at a maximum distance from the first actuator assembly Thomson coil 104, the first actuator assembly Thomson coil armature 106 is in its first position. Thus, when the first actuator assembly 100 is actuated, the movable contact 20 moves away from the fixed contact 22. That is, the movable contact 20 moves from the second configuration to the first configuration. Moreover, as noted above, movable contact 20 moves from the second configuration to the first configuration rapidly, very rapidly, or exceedingly rapidly. This solves the problem(s) noted above. After the movable contact 20 is in the first configuration, the first actuator assembly Thomson coil 104 is de-energized.

In an alternate embodiment, the first actuator assembly 100 does not include the first actuator assembly latching magnet 110 and the first actuator assembly unlatching coil 112. In this embodiment, the first actuator assembly Thomson coil 104 is structured to generate an EM field of sufficient strength to overcome the attractive bias of the first actuator assembly latching magnet 110. Thus, the first actuator assembly Thomson coil 104 is structured to, and does, separate the first actuator assembly Thomson coil armature 106 and the first actuator assembly latching magnet 110. This motion also moves the movable contact 20 from the second configuration to the first configuration.

The second actuator assembly 200 includes a housing assembly 202, a closing coil 204, a closing armature 206, an elongated stem 208, and a return assembly 210. The second actuator assembly housing assembly 202 includes a generally toroidal sidewall 220, a first end member 222 and a second end member 224. The second actuator assembly housing assembly sidewall 220 has a first end 226 and a second end 228. The second actuator assembly housing assembly first end member 222 is generally toroidal and defines a central passage, not numbered. The second actuator assembly housing assembly first end member 222 is coupled, directly coupled, or fixed to the second actuator assembly housing assembly sidewall first end 226. The second actuator assembly housing assembly second end member 224, which is generally circular, i.e., disk-like, is coupled, directly coupled, or fixed to the second actuator assembly housing assembly sidewall second end 228. Thus, the second actuator assembly 200 defines an enclosed space 229. Further, in an exemplary embodiment, the first actuator assembly housing assembly sidewall 120 and the second actuator assembly housing assembly sidewall 220 are unitary, or, are coupled so that the axes thereof are generally aligned or are generally coextensive.

The second actuator assembly closing coil 204 includes a wire or similar construct, not numbered, that is structured to be, and is, selectively in electrical communication with a power source, not shown. The second actuator assembly closing coil 204 is generally toroidal. It is understood that the second actuator assembly closing coil 204 is structured to, and does, generate an EM field.

The second actuator assembly closing armature 206 includes a body 240 having a first portion 242 and a second portion 244. The second actuator assembly closing armature body first portion 242 is generally cylindrical and has a radius that is slightly smaller than the central passage of the second actuator assembly closing coil 204. The second actuator assembly closing armature body second portion 244 is generally disk-like and has a radius that generally corresponds to the radius of the second actuator assembly closing coil 204.

The second actuator assembly closing armature body 240 is made from a Ferro-magnetic material. The second actuator assembly stem 208 includes an elongated body 250, which, in an exemplary embodiment, is generally cylindrical. The second actuator assembly stem body has a first end 252 and a second end 254. Further, the second actuator assembly stem body 250 has a length sufficient to extend to be generally parallel with, or extend through, the passage in the second actuator assembly housing assembly second end member 224 when assembled, as discussed below. That is, when assembled, the second actuator assembly stem body first end 252 is generally parallel with, or extends through, the passage in the second actuator assembly housing assembly second end member 224. Further, or alternately, the second actuator assembly stem body 250 has a length sufficient so that, when assembled, and when the first actuator assembly Thomson coil armature 106 is in its first position, the second actuator assembly stem body first end 252 contacts the first actuator assembly Thomson coil armature 106.

The second actuator assembly return assembly 210 is structured to, and does, move the second actuator assembly closing armature 206 from a second position to a first position, as discussed below. In an exemplary embodiment, the second actuator assembly return assembly 210 includes a biasing device 211 such as, but not limited to, a coil spring 260. In an alternate embodiment, not shown, the second actuator assembly return assembly 210 includes a resilient, compressible foam body having a toroid shape. Thus, the second actuator assembly return assembly 210 moves between a compressed configuration and an expanded configuration.

The second actuator assembly 200 is assembled as follows. The second actuator assembly closing coil 204 is disposed in the second actuator assembly housing assembly 202 adjacent the second actuator assembly housing assembly sidewall second end 228. The second actuator assembly stem 208 is coupled, directly coupled, or fixed to the second actuator assembly closing armature 206 with the axes thereof generally aligned. The second actuator assembly closing armature 206 is movably disposed in the second actuator assembly housing assembly 202. That is, the second actuator assembly closing armature first portion 242 is disposed generally within the central passage of the second actuator assembly closing coil 204. Hereinafter, this is identified as the second actuator assembly closing armature 206 first position. Further, the second actuator assembly closing armature second portion 244 is disposed adjacent, or immediately adjacent, the upper (as shown) axial surface of the second actuator assembly closing coil 204. In this configuration, the second actuator assembly stem 208 extends through the passage in the second actuator assembly housing assembly first end member 222. The second actuator assembly return assembly 210 is disposed about the second actuator assembly stem 208. Further, the second actuator assembly return assembly 210 contacts and engages the second actuator assembly housing assembly first end member 222 and the second actuator assembly closing armature second portion 244. As noted above, the second actuator assembly housing assembly 202 is unitary with, or coupled, directly coupled, or fixed, to the first actuator assembly housing assembly 102 with the axes thereof aligned or coextensive. In this configuration, the second actuator assembly housing assembly first end member 222 limits the motion of the first actuator assembly Thomson coil armature 106. That is, when the first actuator assembly Thomson coil armature 106 is in its first position, the first actuator assembly Thomson coil armature 106 is disposed adjacent, immediately adjacent, or abutting the second actuator assembly housing assembly first end member 222.

As shown in FIGS. 6A-6E, the second actuator assembly 200 operates as follows. It is noted that, as shown, the automatic contact position adjustment assembly 300 as well as how the automatic contact position adjustment assembly 300 effects the closing procedure, which is discussed below. As this is a "closing" second actuator assembly 200, it is understood that the movable contact 20 is in the open, first configuration initially. It is further noted that when the movable contact 20 is in the open, first configuration, the first actuator assembly Thomson coil armature 106 is in its first position, i.e., abutting the upper/outer axial surface of the second actuator assembly housing assembly first end member 222. Thus, the second actuator assembly stem body first end 252 is disposed adjacent, immediately adjacent, or abutting the first actuator assembly Thomson coil armature 106. Further, the second actuator assembly return assembly 210 is initially in its expanded configuration.

When the second actuator assembly closing coil 204 is energized, the second actuator assembly closing coil 204 generates an EM field with sufficient strength to move/repel the second actuator assembly closing armature 206 away therefrom. That is, the second actuator assembly closing armature 206 moves to a second position wherein the second actuator assembly closing armature 206 is adjacent the second actuator assembly housing assembly first end member 222. As the second actuator assembly closing armature 206 moves upwardly (as shown in FIG. 2), the second actuator assembly stem 208 operatively engages the first actuator assembly Thomson coil armature 106 and moves the first actuator assembly Thomson coil armature 106 to its second position. As noted above, when the first actuator assembly Thomson coil armature 106 is in its second position, the movable contact 20 is in the second configuration. Thus, the second actuator assembly 200 is structured to, and does, move the movable contact 20 from the first configuration to the second configuration.

As the second actuator assembly closing armature 206 moves into its second position, the second actuator assembly return assembly 210 is compressed. That is, the second actuator assembly return assembly 210 is moved into the compressed configuration. Further, as the second actuator assembly closing armature 206 moves into its second position, the second actuator assembly closing coil 204 is de-energized. When the second actuator assembly closing coil 204 is de-energized, the electromagnetic bias on the second actuator assembly closing armature 206 is terminated and the second actuator assembly return assembly 210 moves to the expanded configuration. As the second actuator assembly return assembly 210 moves to the expanded configuration, the second actuator assembly return assembly 210 biases the second actuator assembly closing armature 206 moving it back to its first position.

As described above, the first actuator assembly 100 is structured to, and does, move the movable contact 20 from the second configuration to the first configuration without operatively engaging any element of the second actuator assembly 200. That is, although the second actuator assembly 200 utilizes the first actuator assembly Thomson coil armature 106 during the closing operation, the second actuator assembly 200 is not moving the movable contact 20, i.e., the actuated element, during the opening operation. Thus, under the definition above, and as used herein, in this configuration the first actuator assembly Thomson coil armature 106 is not part of the second actuator assembly 200 during the opening operation. Accordingly, the first actuator assembly 100 moves the movable contact 20 from the second configuration to the first configuration without operatively engaging any element of the second actuator assembly 200. Thus, the first actuator assembly 100 is an independent split cooperative actuator. Conversely, the second actuator assembly 200 utilizes the first actuator assembly Thomson coil armature 106 during the closing operation and, as such, is a "mutual" split cooperative actuator under the definition above.

Further, in an exemplary embodiment, the first actuator assembly 100 is structured to, and does, move the movable contact 20 from the second configuration to an initial gap in about 1 ms. In this configuration arc voltage builds quickly, i.e., in about 1 ms, and begins circuit interruption, so that circuit interruption can be completed very quickly, i.e., in about 1 ms while the current is relatively low. For example, the rate of rise of current during a short circuit is 5,000 amps per ms (millisecond) in a 600 vDC system with 10,000 amps available and a system time constant of 1.2 ms. Therefore, the short circuit current will be lower if the contacts 20 can be moved to an initial gap of 1.5 mm. In this embodiment, the movable contact 20 moves from the initial gap to the first configuration in about 1.0 ms. Thus, the total time for the contact 20 to move from the second position to the first position is about 2.0 ms, i.e., exceedingly rapidly.

In another embodiment, the vacuum circuit breaker assembly 11 further includes an automatic contact position adjustment assembly 300. The automatic contact position adjustment assembly 300 is structured to, and does, move the operating mechanism 14, or a number of elements thereof, so as to compensate for changes in the movable contact 20 and/or the fixed contact 22. That is, as is known, the movable contact 20 and/or the fixed contact 22 wear over time and become thinner. Thus, the operating mechanism 14, or a number of elements thereof, must be altered/reconfigured so as to accommodate the wear of the contacts 20, 22.

In an exemplary embodiment, the automatic contact position adjustment assembly 300 is a floating automatic contact position adjustment assembly 302. That is, the floating automatic contact position adjustment assembly 302 is not coupled to an element of the operating mechanism 14 in a rigid manner or a rotatable manner. As shown, the floating automatic contact position adjustment assembly 302 includes a number of biasing devices 304, 306. The floating automatic contact position adjustment assembly biasing devices 304, 306 are each structured to move between an expanded, first configuration, and compressed, second configuration. The floating automatic contact position adjustment assembly biasing devices 304, 306 are shown schematically but are, in an exemplary embodiment, springs. In an alternate embodiment, the floating automatic contact position adjustment assembly biasing devices 304, 306 are a resilient, compressible foam.

As shown, a floating automatic contact position adjustment assembly first biasing device 304 is disposed between a rigid, unmoving element such as, but not limited to, the circuit breaker assembly housing assembly, not numbered, and the combined first actuator assembly housing assembly 102/second actuator assembly housing assembly 202 (hereinafter, the "automatic contact position adjustment assembly housing assembly" 308). Thus, in an exemplary embodiment, the floating automatic contact position adjustment assembly first biasing device 304 is operatively coupled to the automatic contact position adjustment assembly housing assembly 308 at a contact adjustment location. That is, as described above, the operating mechanism 14, with the exception of power sources, is disposed within the automatic contact position adjustment assembly housing assembly 308. Thus, in this configuration, the floating automatic contact position adjustment assembly first biasing device 304 biases the operating mechanism 14 towards the contacts 20, 22. As the contacts 20, 22 wear, the bias of the floating automatic contact position adjustment assembly first biasing device 304 causes the operating mechanism 14 to move toward the contacts 20, 22. Thus, the automatic contact position adjustment assembly 300 moves the operating mechanism 14, or a number of elements thereof, so as to compensate for changes in the movable contact 20 and/or the fixed contact 22.

In another embodiment, the floating automatic contact position adjustment assembly 302 includes a floating automatic contact position adjustment assembly second biasing device 306. In this embodiment, the movable contact stem 24 and/or the first actuator assembly stem 108 includes a radially extending flange 310 (hereinafter the "stem flange" 310) disposed adjacent the first actuator assembly housing assembly end member 122 and within the first actuator assembly housing assembly enclosed space 126. The floating automatic contact position adjustment assembly second biasing device 306 is disposed between the stem flange 310 and the first actuator assembly housing assembly end member 122. When the first actuator assembly Thomson coil armature 106 is in the first position, the floating automatic contact position adjustment assembly second biasing device 306 is in the first configuration. When the first actuator assembly Thomson coil armature 106 is in the second position, the floating automatic contact position adjustment assembly second biasing device 306 is in the second configuration. In an exemplary embodiment, the floating automatic contact position adjustment assembly first biasing device 304 is much stronger than the floating automatic contact position adjustment assembly second biasing device 306.

In an embodiment with a floating automatic contact position adjustment assembly 302 as described above, the opening and closing operations affect the floating automatic contact position adjustment assembly 302. That is, in addition to the operations detailed above, the following occur. As shown in FIGS. 6A-6E, during the opening operation, after the first actuator assembly Thomson coil armature 106 moves to the first position, the first and second floating automatic contact position adjustment assembly biasing devices 304, 306 expand to the first configuration. It is understood that this expansion does not move the operating mechanism 14, and therefore the movable contact 20, a sufficient distance so as to contact the fixed contact 22. The first and second floating automatic contact position adjustment assembly biasing devices 304, 306 do move, and as shown lift, the automatic contact position adjustment assembly housing assembly 308.

Thus, prior to a closing operation, the first and second floating automatic contact position adjustment assembly biasing devices 304, 306 are in the first configuration. As the closing operation occurs, an initial motion of the second actuator assembly closing armature 206 moves the movable contact 20 to the second configuration but does not move the first actuator assembly Thomson coil armature 106 into its second position. That is, while the movable contact 20 is in the second configuration, the first actuator assembly Thomson coil armature 106 is not latched by the first actuator assembly latching magnet 110 and the first and second floating automatic contact position adjustment assembly biasing devices 304, 306 are generally, or substantially, in the first configuration. The continued bias from the second actuator assembly closing coil 204, which is disposed at the second actuator assembly housing assembly sidewall second end 228, now causes the automatic contact position adjustment assembly housing assembly 308 to move downwardly (as shown). This motion of the automatic contact position adjustment assembly housing assembly 308 compresses the first and second floating automatic contact position adjustment assembly biasing devices 304, 306 so that they are in the second configuration. Further, the motion of the automatic contact position adjustment assembly housing assembly 308 moves the latching magnet 110 downwardly (as shown) until the first actuator assembly Thomson coil armature 106 is effectively within the first actuator assembly latching magnet's 110 electromagnetic field, i.e., until the first actuator assembly Thomson coil armature 106 is in the second configuration. When the first actuator assembly Thomson coil armature 106 is in its second configuration, and latched, the first and second floating automatic contact position adjustment assembly biasing devices 304, 306 are maintained in their second configuration. In this configuration, the first and second floating automatic contact position adjustment assembly biasing devices 304, 306 bias the automatic contact position adjustment assembly housing assembly 308 thereby automatically moving the operating mechanism 14 so as to compensate for changes in the movable contact 20 and/or the fixed contact 22.

In another exemplary embodiment, the vacuum circuit breaker assembly 11 includes two movable contacts, i.e., a movable first contact 20' and a movable second contact 20" but no fixed contact. Thus, the vacuum chamber 40 includes a sidewall 42 a first bellows 46' and a second bellows 46", and, the conductor assembly 12 includes a movable first contact stem 24' and a movable second contact stem 24". The first contact stem 24' is coupled, directly coupled, or fixed to, and is in electrical communication with, the first contact 20'. The second contact stem 24" is coupled, directly coupled, or fixed to, and is in electrical communication with, the second contact 20". The first contact stem 24' is sealingly coupled to the first bellows 46'. The second contact stem 24" is sealingly coupled to the second bellows 46".

In this configuration, both the first contact 20' and the second contact 20" move. That is, both the first contact 20' and the second contact 20" move between a withdrawn, first position, wherein the contacts 20', 20" are spaced, and are not in electrical communication, and, an extended, second position, wherein the contacts 20', 20" are coupled or directly coupled to, and in electrical communication with, each other.

In this embodiment, the operating mechanism 14 includes two opening, first actuator assemblies 100', 100" and two closing, second actuator assemblies 200', 200". That is, in this embodiment, the opening, first actuator assembly 100 includes a first contact opening actuator assembly 100' and a second contact opening actuator assembly 100" while the second actuator assembly 200 includes a first contact closing actuator assembly 200' and a second contact closing actuator assembly 200". Further, to avoid the nomenclature of a "first" actuator assembly 100' and a "second first" actuator assembly 100", and similar terms, hereinafter, the actuator assemblies associated with the first contact 20' are identified as the "first contact opening actuator assembly" 100' and the "first contact closing actuator assembly" 200'. Similarly, the actuator assemblies associated with the second contact 20" are identified as the "second contact opening actuator assembly" 100" and the "second contact closing actuator assembly" 200".

The individual first and second opening and closing actuator assemblies 100', 100', 200', 200" are substantially similar to the opening and closing actuator assemblies 100, 200, described above. That is, the first contact opening actuator assembly 100' is identical, or substantially similar, to the first actuator assembly 100 described above. Similarly, the first contact closing actuator assembly 200' is identical, or substantially similar, to the second actuator assembly 200 described above. Thus, hereinafter, the components of the first contact opening first actuator assembly 100' and the first contact opening closing actuator assembly 200' use the same reference numbers along with a "prime" mark, i.e., "'" as the corresponding components discussed above.

The second contact opening and closing actuator assemblies 100", 200" are also similar to the first actuator assembly 100 and the second actuator assembly 200 described above, but are inverted as shown in FIG. 7. Thus, the second contact opening actuator assembly 100" shall use the same reference numbers as the first actuator assembly 100 along with a "double prime" mark, i.e., "",," and, the second contact closing actuator assembly 200" shall use the same reference numbers as the second actuator assembly 200 along with a "double prime" mark.

That is, for example, the first contact opening actuator assembly 100' includes a first contact opening actuator assembly first actuator assembly housing assembly 102', a first contact opening actuator assembly first actuator assembly Thomson coil 104', a first contact opening actuator assembly first actuator assembly Thomson coil armature 106', a first contact opening actuator assembly first actuator assembly stem 108', a first contact opening actuator assembly first actuator assembly latching magnet 110' and a first contact opening actuator assembly first actuator assembly unlatching coil 112'. Accordingly, the second contact opening actuator assembly 100" includes a second contact opening actuator assembly first actuator assembly housing assembly 102", a second contact opening actuator assembly first actuator assembly Thomson coil 104", a second contact opening actuator assembly first actuator assembly Thomson coil armature 106", a second contact opening actuator assembly first actuator assembly stem 108", a second contact opening actuator assembly first actuator assembly latching magnet 110" and a second contact opening actuator assembly first actuator assembly unlatching coil 112". It is understood that this naming convention applies to all reference numbers of this embodiment even if those reference numbers are not specifically recited herein.

The first contact opening actuator assembly 100' is structured to, and does, move the first contact 20' from the second position to the first position, and, the first contact closing actuator assembly 200' is structured to, and does, move the first contact 20' from the first position to the second position. Similarly, the second contact opening actuator assembly 100" is structured to, and does, move the second contact 20" from the second position to the first position, and, the second contact closing actuator assembly 200" is structured to, and does, move the second contact 20" from the first position to the second position. Moreover, in an exemplary embodiment, each movable contact 20', 20" moves about half the distance relative to the single movable contact 20 embodiment described above.

Figure 7:
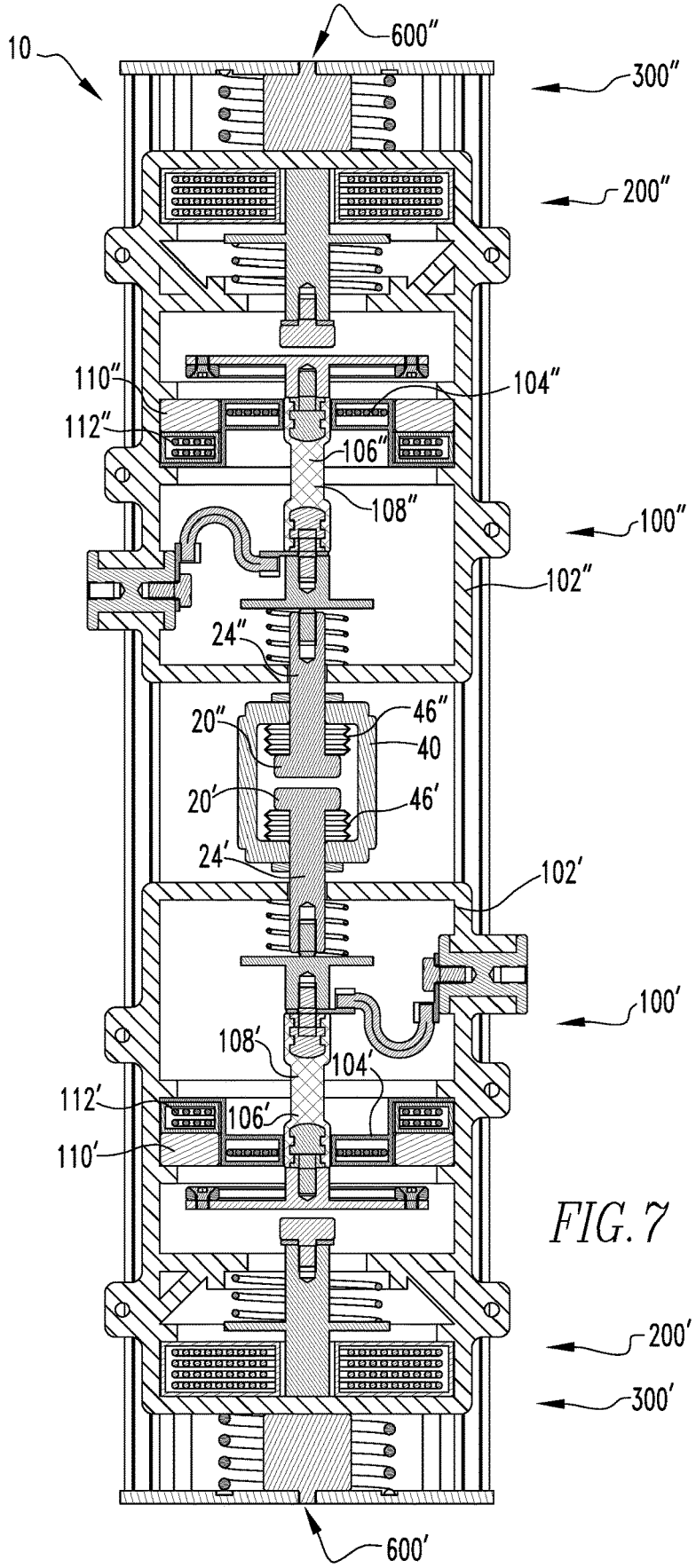
FIG. 7 is a schematic side cross-sectional view of an operating mechanism including split cooperative actuator assemblies with two movable contacts in an open, first configuration.

The second contact opening actuator assembly 100" is substantially similar, to the first actuator assembly 100 described above, but the elements are inverted, as shown in FIG. 7. Similarly, the second contact closing actuator assembly 200" is substantially similar, to the second actuator assembly 200 described above, but the elements are inverted. As such, the first contact and second contact opening and closing actuator assemblies 100', 100", 200', 200 are not described again in detail.

In this embodiment, the first and second opening actuator assemblies 100', 100", utilize less kinetic energy and are exposed to less stress than in an embodiment having a single opening, first actuator assembly 100, provided that the moving contacts have a high velocity, as defined above, at the fully open second position. This is not true if the moving contacts decelerate velocity to a low velocity at the fully open second position. As used herein, a "low velocity" is a velocity lower than a "high velocity" as defined above. That is, in an embodiment with a single opening, first actuator assembly 100, the first actuator assembly 100 utilizes opening [X] energy (kinetic+potential) to perform an opening operation. In this embodiment, each of the first and second opening actuator assemblies 100', 100" only needs to move the associated movable contact 20', 20" half the distance at half the speed. Thus, in this embodiment, the first contact opening actuator assembly 100' is structured to, and does, use [½ X] kinetic energy when moving the first contact 20' from the second position to the first position at high velocity, and, the second contact opening actuator assembly 100" is structured to, and does, use [½ X] kinetic energy when moving the second contact 20" from the second position to the first position at high velocity. This solves the problem(s) noted above.

Further, in this embodiment, the elements of the first and second opening actuator assemblies 100', 100" do not need to be, and are not, as robust as the elements of an opening actuator assembly in the prior art. That is, the first contact opening actuator assembly 100 is a minimally robust contact opening actuator assembly, and, the second contact opening actuator assembly 100" is a minimally robust contact opening actuator assembly.

For example, in an embodiment wherein the Thomson coil armature 106 has the following characteristics: coil inner diameter=2 inch, coil outer diameter=5 inch, 15 turns of 11 awg wire, where the Thomson coil 104 is a copper eddy current plate with the same inner diameter and outer diameter as the Thomson coil armature 106. The Thomson coil further includes a 0.01 farad capacitor (not shown). A vacuum circuit breaker assembly 11 with a single Thomson coil armature 106 (1.5 kg moving mass, 1.5 mm gap at 1 ms) requires a capacitor charge of 120 volts (to achieve a high final velocity at the fully open position).

Conversely, in an embodiment wherein the vacuum circuit breaker assembly 11 has two Thomson coil actuators 106', 106", the Thomson coil actuators 106', 106" each moving mass of 0.75 kg which must move 0.75 mm (for a total gap of 1.5 mm) within 1 ms. In this configuration, each Thomson coil capacitor (not shown) has a charge of 60 volts (on each of the 2 capacitors). The capacitor charge energy (Ec) is equal to half of the capacitor capacitance multiplied by the square of the capacitor charge voltage ($Ec=0.5\ C\ v^2$) for the single Thomson coil. That is, in a configuration with a single first actuator assembly 100, i.e., a single Thomson coil 104, the capacitor charge energy is 72 joules. Conversely, in a configuration with two first actuator assemblies 100', 100", the Thomson coil capacitor charge energy is 36 joules (2×18). This demonstrates that a circuit breaker assembly 11 with two opening, first actuator assemblies 100', 100" requires only half of the capacitor charge energy compared to a circuit breaker assembly 10 with a single opening, first actuator assembly 100.

Further, while not discussed in detail above, it is understood that in this embodiment, the operating mechanism 14 further includes two automatic contact position adjustment assemblies 300', 300" and two dampening assemblies 600', 600". As with the first and second opening actuator assemblies 100', 100" and the first and second actuator assemblies 200', 200", the two automatic contact position adjustment assemblies 300', 300" are hereinafter identified as the first automatic contact position adjustment assembly 300', which is identical or substantially similar to the automatic contact position adjustment assembly 300 described above, and, the second automatic contact position adjustment assembly 300", which, other than being inverted, is identical or substantially similar to the automatic contact position adjustment assembly 300 described above. Similarly, the two dampening assemblies 600', 600" are hereinafter identified as the first dampening assembly 600', which is identical or substantially similar to the dampening assembly 600 described below, and, the second dampening assembly 600", which, other than being inverted, is identical or substantially similar to the dampening assembly 600 described below.

As the operating mechanism 14 disclosed herein moves elements very fast, in an exemplary embodiment, the operating mechanism 14 includes a dampening assembly 600. The dampening assembly 600 includes a number of dampeners 602 wherein each dampener 602 is structured to, and does, slow the velocity of another element. In an exemplary embodiment, the second actuator assembly stem body first end 252 includes a dampener 602 such as, but not limited to, a resilient body 604. In another embodiment, the automatic contact position adjustment assembly 300 acts as a dampener and/or includes a resilient body 606 having different compression and resiliency characteristics relative to the floating automatic contact position adjustment assembly first biasing device 304. In another embodiment, not shown, the upper and lower surfaces of the Thomson coil armature 106 include a layer, or separate pads, that are resilient. It is understood that, while resilient dampeners 602 are mentioned above, any type of dampeners 602 such as, but not limited to, dashpots, or elastomers or electromagnetic damping assemblies are also contemplated.

Further, in view of the rapid operating mechanism 14 disclosed herein, the bellows 46, 46', 46" disclosed herein are, in an exemplary embodiment, reinforced. That is, in an exemplary embodiment, the bellows 46, 46', 46" include a support, not shown. That is, the bellows' support includes constructs such as, but not limited to, fluids (disposed in a sealed housing), elastomers or fibrous fillers which are coupled to the atmospheric side of the bellows 46, 46', 46".

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of invention which is to be given the full breadth of the claims appended and any and all equivalents thereof.

What is claimed is:

1. An operating mechanism for a circuit breaker assembly, said circuit breaker assembly including a first contact and a second contact, wherein at least one of said first contact and said second contact is a movable contact, said at least one movable contact structured to move between an open, first configuration, wherein the contacts are spaced from each other and are not in electrical communication, and a closed, second configuration, wherein the contacts are directly coupled to each other and are in electrical communication, said operating mechanism comprising:

an opening, first actuator assembly;

said first actuator assembly structured to operatively engage said at least one movable contact and structured to move said at least one movable contact from said second configuration to said first configuration;

a closing, second actuator assembly;

said second actuator assembly structured to operatively engage said at least one movable contact and structured to move said at least one movable contact from said first configuration to said second configuration;

wherein said first actuator assembly and said second actuator assembly are split cooperative actuators;

wherein said first contact is a movable contact and said second contact is a movable contact, said first contact movable between a withdrawn, first position and an extended, second position, said second contact movable between a withdrawn, first position and an extended, second position, and wherein;

said first actuator assembly includes a first contact opening actuator assembly and a second contact opening actuator assembly;

said first contact opening actuator assembly structured to move said first contact from said second position to said first position;

said second contact opening actuator assembly structured to move said second contact from said second position to said first position;

said second actuator assembly includes a first contact closing actuator assembly and a second contact closing actuator assembly;

said first contact closing actuator assembly structured to move said first contact from said first position to said second position; and said second contact closing actuator assembly structured to move said second contact from said first position to said second position.

2. The operating mechanism of claim 1 wherein said first actuator assembly and said second actuator assembly are split bi-directional cooperative actuator assemblies.

3. The operating mechanism of claim 1 wherein said first actuator assembly is structured to rapidly move said at least one movable contact from said second configuration to said first configuration.

4. The operating mechanism of claim 1 wherein:

said first contact opening actuator assembly structured to use [½ X] kinetic energy when moving said first contact from said second position to said first position; and said second contact opening actuator assembly structured to use [½ X] kinetic energy when moving said second contact from said second position to said first position.

5. The operating mechanism of claim 4 wherein:

said first contact opening actuator assembly is a minimally robust contact opening actuator assembly; and said second contact opening actuator assembly is a minimally robust contact opening actuator assembly.

6. The operating mechanism of claim 1 wherein:

said first actuator assembly includes a housing assembly, a Thomson coil, a Thomson coil armature, and an elongated stem;

said first actuator assembly stem structured to be coupled to said movable contact;

said first actuator assembly Thomson coil armature fixed to said first actuator assembly stem;

said first actuator assembly Thomson coil fixed to said first actuator assembly housing assembly;

said first actuator assembly Thomson coil armature and said first actuator assembly stem movably disposed in said first actuator assembly housing assembly; and said first actuator assembly Thomson coil armature structured to move between a second position, wherein said first actuator assembly Thomson coil armature is disposed adjacent said first actuator assembly Thomson coil, and a first position, wherein said first actuator assembly Thomson coil armature is spaced from said first actuator assembly Thomson coil.

7. The operating mechanism of claim 6 wherein:

said first actuator assembly includes a latching magnet and an unlatching coil;

said first actuator assembly latching magnet structured to generate an electromagnetic field;

said actuator assembly latching magnet coupled to said actuator assembly housing assembly and disposed so that said first actuator assembly Thomson coil armature is effectively within said first actuator assembly latching magnet's electromagnetic field when said first actuator assembly Thomson coil armature is in said second position;

said first actuator assembly unlatching coil structured to selectively generate an electromagnetic field structured to reduce said actuator assembly latching magnet's electromagnetic field; and said first actuator assembly unlatching coil disposed an effective distance from said actuator assembly latching magnet.

8. The operating mechanism of claim 6 wherein:

said second actuator assembly includes a housing assembly, a closing coil, a closing armature, and an elongated stem;

said second actuator assembly closing armature fixed to said second actuator assembly stem;

said second actuator assembly closing coil fixed to said second actuator assembly housing assembly;

said second actuator assembly closing armature and said second actuator assembly stem movably disposed in said second actuator assembly housing assembly;

wherein a longitudinal axis of said second actuator assembly stem is generally aligned with a longitudinal axis of first actuator assembly stem; and wherein said second actuator assembly closing armature is structured to move between a first position, wherein said second actuator assembly closing armature is disposed adjacent to said second actuator assembly closing coil, and a second position, wherein said second actuator assembly closing armature is spaced from said second actuator assembly closing coil.

9. The operating mechanism of claim 1 wherein said circuit breaker is a vacuum circuit breaker including a vacuum chamber, said contacts disposed within said vacuum chamber, wherein said operating mechanism further includes an automatic contact position adjustment assembly.

10. The operating mechanism of claim 9 wherein said automatic contact position adjustment assembly is a floating automatic contact position adjustment assembly.

11. The operating mechanism of claim 1 wherein:

said first actuator assembly is an independent split cooperative actuator assembly; and said second actuator assembly is a mutual split cooperative actuator assembly.

12. An operating mechanism for a circuit breaker assembly, said circuit breaker assembly including a first contact and a second contact, wherein at least one of said first contact and said second contact is a movable contact, said at least one movable contact structured to move between an open, first configuration, wherein the contacts are spaced from each other and are not in electrical communication, and a closed, second configuration, wherein the contacts are directly coupled to each other and are in electrical communication, said operating mechanism comprising:

an opening, first actuator assembly;

said first actuator assembly structured to operatively engage said at least one movable contact and structured to move said at least one movable contact from said second configuration to said first configuration;

a closing, second actuator assembly;

said second actuator assembly structured to operatively engage said at least one movable contact and structured to move said at least one movable contact from said first configuration to said second configuration;

wherein said first actuator assembly and said second actuator assembly are split cooperative actuators;

wherein said second actuator assembly includes a housing assembly, a closing coil, a closing armature, and an elongated stem;

wherein said second actuator assembly closing armature fixed to said second actuator assembly stem;

wherein said second actuator assembly closing coil fixed to said second actuator assembly housing assembly;

wherein said second actuator assembly closing armature and said second actuator assembly stem movably disposed in said second actuator assembly housing assembly;

wherein a longitudinal axis of said second actuator assembly stem is generally aligned with a longitudinal axis of first actuator assembly stem; and wherein said second actuator assembly closing armature is structured to move between a first position, wherein said second actuator assembly closing armature is disposed adjacent to said second actuator assembly closing coil, and a second positon, wherein said second actuator assembly closing armature is spaced from said second actuator assembly closing coil; and wherein:

said second actuator assembly includes a biasing device;

said second actuator assembly biasing device is a spring;

said second actuator assembly biasing device spring operatively coupled to said second actuator assembly closing armature; and said second actuator assembly biasing device spring structured to move said second actuator assembly closing armature from said second position to said first position.

13. The operating mechanism of claim 12 wherein;

said automatic contact position adjustment assembly includes a housing assembly and a number of biasing devices;

said first actuator assembly and said second actuator assembly disposed within said automatic contact position adjustment assembly housing assembly;

said automatic contact position adjustment assembly number of biasing devices includes first biasing device; and said automatic contact position adjustment assembly first biasing device operatively coupled to said automatic contact position adjustment assembly housing assembly at a contact adjustment location.

14. A circuit breaker assembly comprising:

a first contact and a second contact, wherein at least one of said first contact and said second contact is a movable contact;

said at least one movable contact structured to move between an open, first configuration, wherein the contacts are spaced from each other and are not in electrical communication, and a closed, second configuration, wherein the contacts are directly coupled to each other and are in electrical communication;

an operating mechanism including an opening, first actuator assembly and a closing, second actuator assembly;

said first actuator assembly structured to operatively engage said at least one movable contact and structured to move said at least one movable contact from said second configuration to said first configuration;

said second actuator assembly structured to operatively engage to said at least one movable contact and structured to move said at least one movable contact from said first configuration to said second configuration; and wherein said first actuator assembly and said second actuator assembly are split cooperative actuator assemblies; and wherein:

said first contact is a movable contact;

said second contact is a movable contact;

said first contact movable between a withdrawn, first position and an extended, second position;

said second contact movable between a withdrawn, first position and an extended, second position;

said first actuator assembly includes a first contact opening actuator assembly and a second contact opening actuator assembly;

said second actuator assembly includes a first contact closing actuator assembly and a second contact closing actuator assembly;

said first contact opening actuator assembly structured to move said first contact from said second position to said first position;

said second contact opening actuator assembly structured to move said second contact from said second position to said first position;

said first contact closing actuator assembly structured to move said first contact from said first position to said second position; and said second contact closing actuator assembly structured to move said second contact from said first position to said second position.

15. The circuit breaker assembly of claim 14 wherein said first actuator assembly and said second actuator assembly are split bi-directional cooperative actuator assemblies.

16. The circuit breaker assembly of claim 14 wherein:

said first actuator assembly is structured to rapidly move said at least one movable contact from said second configuration to said first configuration.

17. The circuit breaker assembly of claim 14 wherein:

said first contact opening actuator assembly structured to use [½ X] kinetic energy when moving said first contact from said second position to said first position; and said second contact opening actuator assembly structured to use [½ X] kinetic energy when moving said second contact from said second position to said first position.

18. The circuit breaker assembly of claim 17 wherein:

said first contact opening actuator assembly is a minimally robust contact opening actuator assembly; and said second contact opening actuator assembly is a minimally robust contact opening actuator assembly.

* * * * *